US006959573B2

(12) United States Patent
Matsumoto et al.

(10) Patent No.: US 6,959,573 B2
(45) Date of Patent: Nov. 1, 2005

(54) BENDING METHOD AND DEVICE THEREFORE

(75) Inventors: Masateru Matsumoto, Isehara (JP); Koichi Yanagawa, Isehara (JP); Ken Hatano, Isehara (JP); Yutaka Takizawa, Isehara (JP)

(73) Assignee: Amada Company, Limited, Kanagawa (JP)

( * ) Notice: Subject to any disclaimer, the term of this patent is extended or adjusted under 35 U.S.C. 154(b) by 305 days.

(21) Appl. No.: 10/343,836

(22) PCT Filed: Aug. 8, 2001

(86) PCT No.: PCT/JP01/06817

§ 371 (c)(1),
(2), (4) Date: Feb. 10, 2003

(87) PCT Pub. No.: WO02/13987

PCT Pub. Date: Feb. 21, 2002

(65) Prior Publication Data

US 2004/0035178 A1 Feb. 26, 2004

(30) Foreign Application Priority Data

Aug. 11, 2000 (JP) ..... 2000-244545
Sep. 6, 2000 (JP) ..... 2000-270580
Dec. 28, 2000 (JP) ..... 2000-403383

(51) Int. Cl.[7] ..... B21D 5/02

(52) U.S. Cl. ..... 72/31.11; 72/31.1; 72/389.3; 72/389.6; 72/702

(58) Field of Search ..... 72/31.1, 31.11, 72/389.3, 389.6, 319, 702

(56) References Cited

U.S. PATENT DOCUMENTS 4,571,834 A 2/1986 Fraser et al.
4,766,675 A 8/1988 Liu
4,864,509 A * 9/1989 Somerville et al. ..... 72/389.3

(Continued)

FOREIGN PATENT DOCUMENTS

EP 594532 4/1994
JP 63157722 6/1988

(Continued)

OTHER PUBLICATIONS

English Language Translation of JP Appln. No. 2–30327.

(Continued)

*Primary Examiner*—David Jones
(74) *Attorney, Agent, or Firm*—Greenblum & Bernstein, P.L.C.

(57) ABSTRACT

A bending apparatus reciprocates at least one of an upper table to which a punch is mounted and a lower table to which a corresponding plurality of adjacent divided dies are mounted. At least one bending angle detector is provided between the dies to detect a bending angle of the workpiece. A main body inserts the bending angle detector into a gap between the dies and withdraws the bending angle detector from the gap between the dies. A lift is biased upward by a first elastic body and is configured to be pressed downward by the workpiece at approximately a center of a groove portion of the dies. The lift includes a first engagement member. A rotor support is biased upward by two second elastic bodies having smaller biasing forces than the first elastic body. The rotor support includes second engagement members. Two rotors are provided on opposite sides of the groove portion at an upper portion of the rotor support. The two rotors include workpiece contacts that contact the workpiece. Links rotatably engage the first engagement member to stop an upper end of the lift in a position lower than an upper surface of the dies, and rotatably engage the second engagement members to position the workpiece contacts below the upper surface of the dies. A bending angle calculator converts rotating amounts of the two rotors into bending angles of the workpiece.

14 Claims, 16 Drawing Sheets

U.S. PATENT DOCUMENTS

| | | | | | |
|---|---|---|---|---|---|
| 5,148,693 | A | | 9/1992 | Sartorio et al. | |
| 5,285,668 | A | | 2/1994 | Tokai | |
| 5,375,340 | A | | 12/1994 | Gerritsen | |
| 5,483,750 | A | | 1/1996 | Ooenoki et al. | |
| 5,584,199 | A | * | 12/1996 | Sartorio | 72/18.6 |
| 5,603,236 | A | | 2/1997 | Hongo | |
| 6,240,646 | B1 | | 6/2001 | Rönnmark et al. | |
| 6,266,984 | B1 | * | 7/2001 | Gasparini | 72/31.11 |
| 6,460,263 | B1 | | 10/2002 | Matsumoto | |
| 6,571,589 | B1 | * | 6/2003 | Ito et al. | 72/31.11 |
| 6,722,181 | B2 | * | 4/2004 | Nagakura | 72/31.1 |
| 2001/0009106 | A1 | | 7/2001 | Gerritsen | |

FOREIGN PATENT DOCUMENTS

| | | |
|---|---|---|
| JP | 2-30327 | 1/1990 |
| JP | 6-238343 | 8/1994 |
| JP | 8-57541 | 3/1996 |
| JP | 10118718 | 5/1998 |
| JP | 10166060 | 6/1998 |
| JP | 10286627 | 10/1998 |
| JP | 2000-140944 | 5/2000 |
| NL | 8105266 | 6/1983 |

OTHER PUBLICATIONS

English Language Translation of JP Appln. No. 63–157722.

English Language Abstract of JP Appln. No. 6–238343.

English Language Abstract of JP Appln. No. 2000–140944.

English Language Abstract of JP Appln. No. 10–118718.

* cited by examiner

BENDING METHOD AND DEVICE THEREFORE

TECHNICAL FIELD

The present invention relates to a bending method in a bending apparatus such as a press brake and an apparatus thereof, and particularly relates to the bending method in a bending apparatus having an angle detecting device for detecting a bending angle of a bent workpiece and the apparatus thereof.

BACKGROUND ART

Conventionally, a press brake is used a lot for bending a plate-shaped workpiece, and when a worked product is manufactured, the bending which provides highly accurate bending angle and flange dimension of a workpiece is strongly desired. For this reason, a bending apparatus which has an angle detecting device for measuring a bending angle of a workpiece instantly and accurately is required.

The above-mentioned angle detecting device 301 is disclosed in Japanese Patent Application Laid-Open No. 6-238343 (1994), and it is, as shown in FIG. 1, provided with a measuring disk 303 having a shape of a flat semicircular disk whose measuring member has a smaller thickness than a width of its plane. The measuring disk 303 is mounted to a disk supporting section 309 of a V groove portion 307 of a mold die 305 so as to rotate through a limited angle.

The die 305 is provided with a lateral slot 211 on one surface of the V groove portion 307 so that the measuring disk 303 can pass through the slot 211, and a center portion 315 of a linear edge portion 313 of the measuring disk 303 can move between a position inside a slot 311 in a vicinity of the V groove portion 307 and a position outside the slot 311.

The disk supporting section 309 which bears the measuring disk 303 is positioned so as to come in contact with a workpiece W bent by the linear edge portion 313 of the measuring disk 303. The disk supporting section 309 is provided with means for detecting an angle position of the measuring disk 303 using, for example, electric, optical or hydrodynamic means, and means for supplying the measured signal. Therefore, the instant bending angle of the workpiece W is detected by the angle position of the measuring disk 303.

Incidentally, in the conventional art, since the measuring disk 303 is provided to the V groove portion 307 of the die 305, the die 305 has the slot 311 for receiving the measuring disk 303. For this reason, the arrangement of the measuring disk 303 is necessary for every replacement of molds according to mold conditions which differ due to workpiece shapes and shape of V grooves different due to plate thickness and the like.

In addition, since one measuring disk 303 exists on one surface of the V groove portion 307 of the die 305, the bending angle detecting device 301 should be set in at least two places in order to measure the bending angle of the workpiece W.

Further, since the measuring disk 303 extends upward from the upper surface of the die 305, when the workpiece W is carried in from the lateral direction so as to slide on the upper surface of the die 305, there arises a problem that interference between the workpiece W and the measuring disk 303 occurs.

In addition, since the measuring disks 303 operate individually so as to follow the sliding of the workpiece W, there arises a problem that its bending angle detecting portion becomes complicated.

Meanwhile, another conventional art has the following problem.

Namely, a press bake is used a lot for bending a plate-shaped workpiece, and highly accurate bending is strongly desired for manufacturing a worked product with high quality. Incidentally, the high accuracy is accuracy of the bending angle and the flange dimension of the bent workpiece. In actual bending, an upper table to which a punch is mounted, for example, is reciprocated, and a workpiece is bent by a cooperation of the punch and the die mounted to a lower table. Here, an angle sensor for measuring the bending angle of a workpiece is mounted to the press brake in a longitudinal direction of the die.

When the bending is carried out, the position of the angle sensor is read by an operator through a scale stuck to the upper table, and the operator inputs the read value into a control device using a ten key.

In addition, the press brake of another example is provided with the angle sensor in the longitudinal direction of the mold movably, and when a workpiece is bent, the angle sensor is automatically moved by the control device so as to measure the bending angle of the workpiece automatically.

In the former one of the conventional arts, when the operator reads the position of the angle sensor mounted to the press brake through the scale of the upper table, the operator reads it by mm unit from the reference position at the left end and memorizes it and moves to the control device so as to input the memorized and read numerical value using the ten key. For this reason, there arises a problem that of troublesome input operation and misinput. Here, since the angle sensor is provided in, for example, three places maximally, the above operation should be repeated three times, and thus this is a troublesome operation for the operator.

In the latter art, although the angle sensor is moved automatically by the control device, in the case where a bending angle cannot be measured because a hole or the like exists in the automatically determined place, there arises a problem that the position of the angle sensor should be input by using the ten key and the provided position of the angle sensor should be adjusted.

The present invention is devised in order to solve the above problems, and its first object is to provide a bending apparatus, which has a bending angle detecting device which does not depend on the mold conditions such as a groove width of the die and R of a groove shoulder portion and in which a disk for measuring a bending angle of a workpiece retreats below the die upper surface so as not to interfere with the workpiece when the workpiece is carried in and which follows according to the bending angle so as to come in contact with a linear portion of the workpiece while avoiding the bent R portion at the time of detecting the bending angle of the workpiece, and which is capable of detecting the bending angle accurately using at least one bending angle detecting device and bending the workpiece.

The second object of the present invention is to provide a bending method and an apparatus thereof which are capable of detecting a position of an angle sensor without input using keys by an operator so as to eliminate an arrangement operation and misinput and detecting a bending angle of a workpiece at real time so as to bend the workpiece accurately.

DISCLOSURE OF THE INVENTION

In order to achieve the above objects, a bending apparatus based on a first aspect for reciprocating any one of an upper table to which punches are mounted and a lower table to which a die is mounted so as to bend a workpiece according to cooperation of the punches and a plurality of adjacent divided dies which extend to a longitudinal direction of the punches and correspond to the punches, comprising: at least one bending angle detecting device, provided between the adjacent divided dies, for detecting a bending angle of the workpiece; a detecting device main body for being capable of inserting and detaching the bending angle detecting device into/from a gap of the adjacent divided dies; a lift member which is normally biased upward by a first elastic body in the detecting device main body and can be pressurized by a bending portion of the workpiece at an approximately center of a groove portion of the divided dies and has a first engagement member; a rotor supporting member which is normally biased upward by two second elastic bodies having smaller biasing forces than that of the first elastic body at left and right sides of the detecting device main body and has second engagement members; two rotors which are borne to both sides of a groove widthwise direction of the divided dies at the upper portion of the rotor supporting member and has workpiece contact portions which come in contact with the workpiece; link members which are engaged with the first engagement member so as to stop the upper end of the lift member in a position lower than the upper surfaces of the divided dies and are engaged with engagement concave portions of the second engagement members so as to position the workpiece contact portions of the two rotors below the upper surfaces of the dies and which are provided to the detecting device main body rotatively; and a bending angle arithmetic unit for converting rotating amounts of the two rotors into bending angles of the workpiece.

Therefore, before starting the bending, since the two rotors retreat below the upper surfaces of the divided dies, when the workpiece is carried onto the die, interference between the workpiece and the rotors can be avoided.

As the bending progresses, when the bending linear portion of the workpiece pushes down the lift member against the biasing force the first elastic body, the first engagement member lowers, and thus the link members rotate so that the second engagement members lifts due to the biasing forces of the second elastic bodies. Since the second engagement members lift, the rotor supporting member lifts and the workpiece contact portions of the two rotors butt against the workpiece, and the the two rotors follow the bending angle of the workpiece so as to rotate. For this reason, the rotating angles are converted into the bending angle of the workpiece by the bending angle arithmetic unit so as to be detected instantly and accurately.

Since the two rotors exist on the rotor supporting member, the bending angle of the workpiece is detected by at least one bending angle detecting device. Further, since the operations of the rotors are only rotation, the structure of the rotors as angle detecting sections is simplified, and the bending angle is measured by the two rotors, so that measuring accuracy is improved.

In addition, since a following mechanism composed of the two rotors is the second elastic body such as a spring element, the mechanism responds to the movement of the workpiece flexibly and instantly.

A bending apparatus based on a second aspect for reciprocating any one of an upper table to which punches are mounted and a lower table to which a die is mounted so as to bend a workpiece according to cooperation of the punches and a plurality of adjacent divided dies which extend to a longitudinal direction of the punches and correspond to the punches, comprising: at least one bending angle detecting device, provided between the adjacent divided dies, for detecting a bending angle of the workpiece; a detecting device main body for being capable of inserting and detaching the bending angle detecting device into/from a gap of the adjacent divided dies; a lift member which is normally biased upward by a first elastic body in the detecting device main body and can be pressurized by a bending portion of the workpiece at an approximately center of a groove portion of the divided dies and has a link engagement member; a damper buffer member provided on an outer peripheral side of the lift member so as to freely lift and lower; guide members which are normally biased upward by two damper elastic bodies at the left and right sides of the damper buffer member, respectively; link members in which their one ends are engaged with the link engagement members lowering according to the lift member and the other ends are engaged with a lower surface of the damper buffer member so as to lift the damper buffer member and which are provided to the detecting device main body rotatively; a rotor supporting member provided integrally with the guide members; two rotors which are borne to both sides of a groove widthwise direction of the divided dies at the upper portion of the rotor supporting member and has workpiece contact portions which come in contact with the workpiece; and a bending angle arithmetic unit for converting rotating amounts of the two rotors into bending angles of the workpiece.

Therefore, as the bending progresses, when the bending linear portion of the workpiece pushes the lift member against the biasing force of the first elastic body and the link engagement member lowers to be engaged with one ends of the link members, the link members are pressurized downward so as to be pivoted and the other ends of the link members lift, so that the damper buffer member lifts. Since the damper buffer member lifts the rotor supporting member together with the guide members via the two damper elastic bodies, the workpiece contact portions of the two rotors butts against the workpiece.

A lowering speed of the lift member at the time of bending, namely, a lift speed of the damper buffer member is different from a leap-up speed of the workpiece, but since the two damper elastic bodies function as dampers and the two rotors follow the bending angle of the workpiece to rotate, their rotating angles are converted into the bending angle of the workpiece by the bending angle arithmetic unit so as to be detected instantly and accurately.

In addition, similarly to the first aspect, since the two rotors exist on the rotor supporting member, the bending angle of the workpiece is detected by at least one bending angle detecting device. Further, since the operation of the rotors is only rotation, the structure of the rotors as the angle detecting section is simplified, and the bending angle is measured by the two rotors so that the measuring accuracy is improved.

In addition, since the following mechanism composed of the two rotors is a damper elastic body such as a spring element, the following mechanism responds to the movement of the workpiece flexibly and instantly.

According to a third aspect, in the bending apparatus based on the first and second aspects, a gap between pivots of the two rotors are wider than a groove width of the divided dies.

Therefore, since the bending angle of the workpiece is detected at the outside of the groove width of the divided dies and is measured on the linear portion avoiding a bending R portion of the workpiece, the bending angle is measured accurately and a detection error is reduced. The bending angle detecting devices are independent devices which do not depend upon mold conditions such as the groove width of the divided dies and R of the shoulder portion.

According to a fourth aspect, in the bending apparatus based on any one of the first through third aspects, the rotors have a semicircular shape having the arc linear type workpiece contact portions.

Therefore, The rotors easily rotate and their structure is simplified, and the linear workpiece contact portions easily follow the linear portion of the workpiece.

According to a fifth aspect, the bending apparatus based on the second aspect further includes stopper sections, provided to the guide members, for constantly restraining a gap in a direction where the guide members and the damper buffer members repel each other due to the biasing forces of the two damper elastic bodies.

Therefore, after the bending is completed, since the lift member is lifted by the first elastic body and the damper buffer members are pushed down by the biasing forces of the two damper elastic bodies, the link members pivot so as to return to their original position. At this time, when the link members return to an approximately horizontal position, the biasing forces of the damper elastic bodies which push down the damper buffer members are restrained by the stopper sections, thereby preventing the link members from biting the damper buffer members.

In order to achieve the second object, a bending method based on a sixth aspect of reciprocating any one of an upper table to which punches are mounted and a lower table to which a die is mounted via a die holder so as to bend a workpiece according to cooperation of the punches and the die, comprising the steps of: previously wiring two rail electrodes composed of a resistance rail electrode and a ground-use rail electrode in a longitudinal direction of the die holder; arranging a plurality of bending angle detecting devices for detecting a bending angle of the workpiece in suitable positions in the longitudinal direction of the die holder; bringing the plural bending angle detecting devices into contact with the two rail electrodes; making the two rail electrodes into conductive during the bending so as to measure resistance values of the resistance rail electrodes from a reference position of the die holder to the bending angle detecting devices; calculating positions of the bending angle detecting devices based on the resistance values; detecting bending angles of the workpiece at real time using the bending angle detecting devices; and carrying out the bending so that the bending angles of the workpiece in the bending angle detecting devices reach a target angle.

Therefore, since the positions of the plural angle detecting devices arranged suitably in the longitudinal direction of the die holder are detected automatically and the bending angles of the workpiece are detected at real time by the bending angle detecting devices, the bending state of the workpiece is detected at real time during the bending and the gaps between the punches and die are adjusted easily, thereby obtaining the workpiece with highly accurate bending angle.

Here, since the positions of the bending angle detecting devices are detected automatically, time conventionally required for reading and mistake of manually inputting the positions of the bending angle detecting devices through an operator is avoided.

According to a seventh aspect, a bending method of reciprocating any one of an upper table to which punches are mounted and a lower table to which a die is mounted via a die holder so as to bend a workpiece according to cooperation of the punches and the die, comprising the steps of: previously wiring a resistance line and an electric wire approximately parallel in a coating body in a longitudinal direction of the lower table so as not to normally come in contact with each other; arranging a plurality of bending angle detecting devices for detecting a bending angle of the workpiece in suitable positions in a longitudinal direction of the die holder; bringing the resistance line and the electric wire into conductive during the bending; externally pushing the plural bending angle detecting devices so as to bring the resistance line and the electric wire into contact with each other; converting resistance values from a reference position of the lower table to the bending angle detecting devices into distances using an electric current flowing at the above step; detecting bending angles of the workpiece at real time using the bending angle detecting devices; and carrying out the bending so that the bending angles of the workpiece in the bending angle detecting devices reach a target angle.

Therefore, the positions of the plural angle detecting devices arranged suitably in the longitudinal direction of the die holder are detected easily simple manual input in such a manner that the resistance line and the electric wire are pushed externally so as to come in contact with each other. Time conventionally required for reading and manually inputting the positions of the bending angle detecting devices through an operator is omitted, and a mistake of manual input is avoided. Further, since the bending angles of the workpiece are detected at real time by the bending angle detecting devices, the bending state of the workpiece is detected at real time during the bending and thus the gaps between the punches and die are adjusted easily, thereby obtaining the workpiece with highly accurate bending angle.

According to an eighth aspect, in the bending method based on the first and the second aspect, a crowning amount is adjusted so that the bending angles of the workpiece in the bending angle detecting devices are made to be uniform.

Therefore, the gap between the punches and the die is adjusted finely and accurately based on a ram driving amount (compensation amount) for obtaining accuracy of a go-angle of the workpiece and a crowning amount so that the workpiece with highly accurate bending angle can be obtained.

A bending apparatus based on a ninth aspect for reciprocating any one of an upper table to which punches are mounted and a lower table to which a die is mounted via a die holder so as to bend a workpiece according to cooperation of the punches and the die, comprising: two rail electrodes composed of a resistance rail electrode wired in a longitudinal direction of the die holder and a ground-use rail electrode; a plurality of bending angle detecting devices for detecting bending angles of workpiece, which are arranged in suitable positions in the longitudinal direction of the die holder so as to come in contact with the two rail electrodes; a position calculating unit for bringing the two rail electrodes into conductive during the bending so as to measure resistance values of the resistance rail electrodes and calculate distances of a reference position of the die holder to the bending angle detecting devices based on the measured resistance values; and a comparison judging device for detecting a bending state of the workpiece from positions of the bending angle detecting devices obtained by the position calculating unit and the bending angles of the workpiece detected at real time by the bending angle detecting devices, wherein in the above structure the comparison judging device compares the detected bending state of the workpiece with a target angle and judges the comparison so as to give an instruction for adjusting the gaps between the punches and the die so as to carry out suitable bending.

Therefore, the function here is similar to that of the sixth aspect, and since the positions of the plural bending angle detecting devices arranged suitably in the longitudinal direction of the die holder are detected automatically and the bending angle of the workpiece is detected at real time by the bending angle detecting devices, the bending angle of the workpiece is detected at real time during the bending and the gap between the punches and the die is adjusted easily, thereby obtaining the workpiece with highly accurately bending angle.

Here, since the positions of the bending angle detecting devices are detected automatically, the time conventionally required for reading and manually inputting the positions of the bending angle detecting devices through the operator is omitted and a mistake of manual input is also avoided.

A bending apparatus based on a tenth aspect for reciprocating any one of an upper table to which punches are mounted and a lower table to which a die is mounted via a die holder so as to bend a workpiece according to cooperation of the punches and the die, comprising: a position detecting device which is constituted so that a resistance line and an electric wire are wired approximately parallel in a coating body extending to a longitudinal direction of the lower table so as not to normally contact with each other; a plurality of bending angle detecting devices, for detecting a bending angle of the workpiece, arranged in suitable positions in a longitudinal direction of the die holder; a position calculating unit for calculating a distance from a reference position of the lower table to the contact position between the resistance line and the electric wire based on an electric current which flows when the resistance line and electric wire are brought into conductive during the bending and the plural bending angle detecting devices are externally pushed so that the resistance line and electric wire are brought into contact with each other; and a comparison judging device for detecting a bending state of the workpiece from the positions of the bending angle detecting devices obtained by the position calculating unit and the bending angles detected at real time by the bending angle detecting devices, wherein in the above structure the comparison judging device compares the detected bending state of the workpiece with a target angle and judges the comparison and giving an instruction for adjusting gaps between the punches and die so that suitable bending is carried out.

Therefore, the function here is similar to that of the second aspect, and the positions of the plural bending angle detecting devices arranged suitably in the longitudinal direction of the die holder are detected easily by simple manual input in such a manner that the resistance line and the electric wire are externally pushed so as to come in contact with each other the time conventionally required for reading and manually inputting the positions of the bending angle detecting devices through the operator is omitted and a mistake of manual input is also avoided. Further, since the bending angle of the workpiece is detected at real time by the bending angle detecting devices, the bending state of the workpiece is detected at real time during the bending, and the gap between the punches and the die is adjusted easily, thereby obtaining the workpiece with highly accurate bending angle.

According to an eleventh aspect, in the bending apparatus based on the ninth or tenth aspect, each of the bending angle detecting devices is composed of: a unit base which can be inserted and detached into/from the gap between the adjacent divided dies; a contact supporting plate which is normally biased upward at the upper portion of the unit base via springs; two semicircular rotational contacts which are borne to both sides of the die widthwise direction at a center of a die groove portion at the upper portion of the contact supporting plate; linear scales which are biased to be drawn freely movable via linear elements, whose one ends are fixed and wound around outer peripheral surfaces of the two rotor contacts, so that arc portions of the two rotor contacts are normally approximately parallel with the upper surface of the die and are approximately flush with the upper surface of the die; and scale moving amount detecting devices for detecting moving amounts of the linear scales.

Therefore, since the bending angle detecting devices can be attached and detached to/from a desired position of the divided dies and the two rotational contacts rotate according to the bending of the workpiece, the linear scales move via the linear elements, and their moving amounts are detected by the scale moving amount detecting devices so that the moving amounts are converted into the bending angles of the workpiece at real time.

THE BEST MODE FOR CARRYING OUT THE INVENTION

There will be explained below embodiments of a bending method and an apparatus thereof according to the present invention by exemplifying a hydraulic press brake as a press brake with reference to the drawings.

Figure 2:
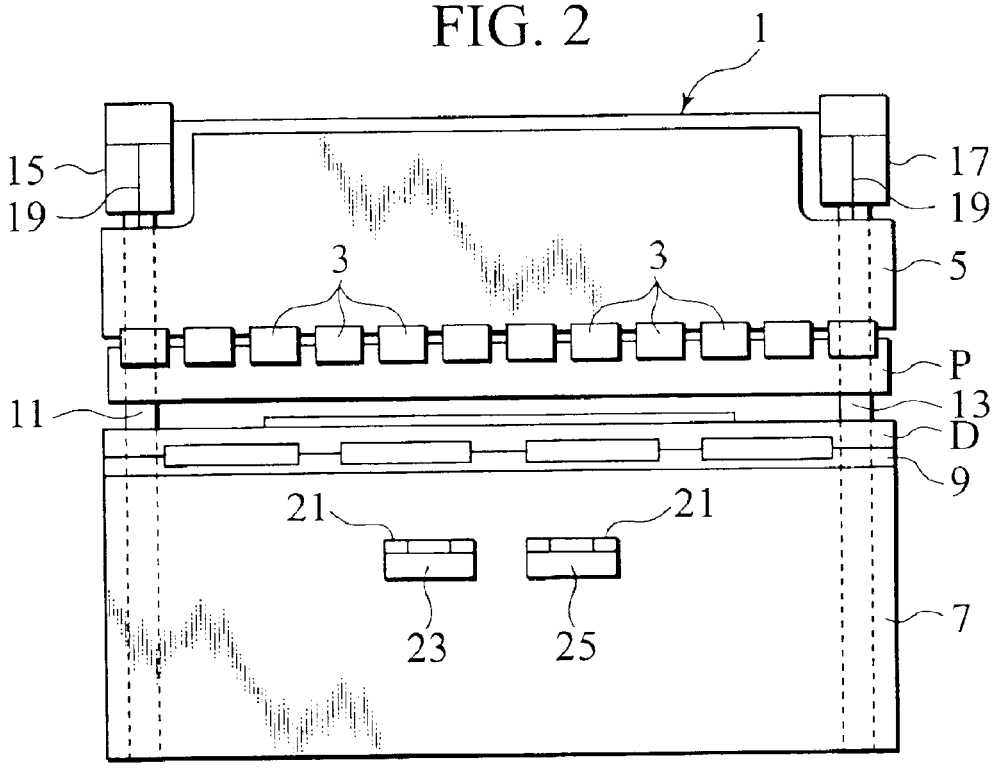
FIG. 2 is a front view of a press brake to be used in an embodiment of the present invention.

With reference to FIG. 2, although a press brake 1 according to the present embodiment refers to a lowering type hydraulic press brake, a lifting type uprising press brake or not a hydraulic type but mechanical press brake such as a crank may be used.

The lowering type hydraulic press brake 1 is mounted and fixed to a lower surface of an upper table 5, for example, as a movable table freely moving up and down, namely a ram, via a plurality of intermediate plates 3 on which punches P are arranged with equal intervals. A die D is mounted and fixed to an upper surface of, for example, a lower table 7 as a fixed table via a die holder 9. Therefore, the upper table 5 lowers, and a plate type workpiece W is bent between the punches P and the die D by cooperation of the punches P and the die D.

Upper portions of left and right side frames 11 and 13 in FIG. 2 composing a main body frame are provided with left axial and right axial hydraulic cylinders 15 and 17, respectively, and lower ends of piston rods 19 of the left axial and right axial hydraulic cylinders 15 and 17 are joined with the upper table 5.

In addition, the lower table 7 is fixed to the lower portions of the left and right side frames 11 and 13, and the center portion of the lower table 7 is provided with notched portions 21, and the notched portions 21 are provided with, for example, two crowning cylinders 23 and 25 (hydraulic cylinders) as crowning devices, respectively. Pressurizing forces of pistons of the crowning cylinders 23 and 25 are controlled, so that a deflection amount of the center portion of the lower table 7 is adjusted.

Figure 5:
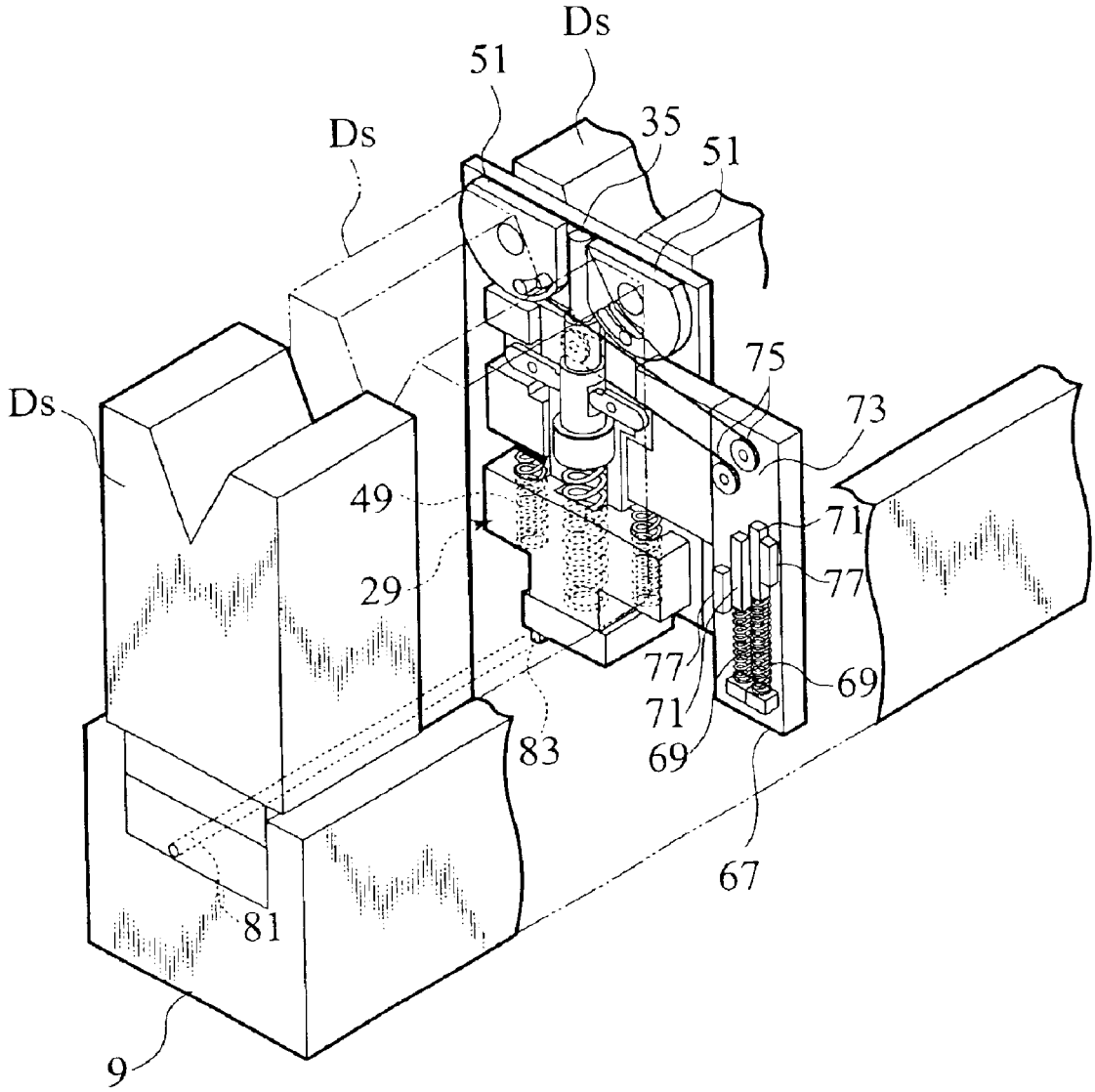
FIG. 5 is a state explanatory diagram in which the bending angle detecting device to be used in the embodiment of the present invention is installed.

Further, the die D of the present embodiment is constituted so that, as shown in FIG. 5, divided dies Ds are combined to be joined and they are mounted to a die holder 9.

Figure 3:
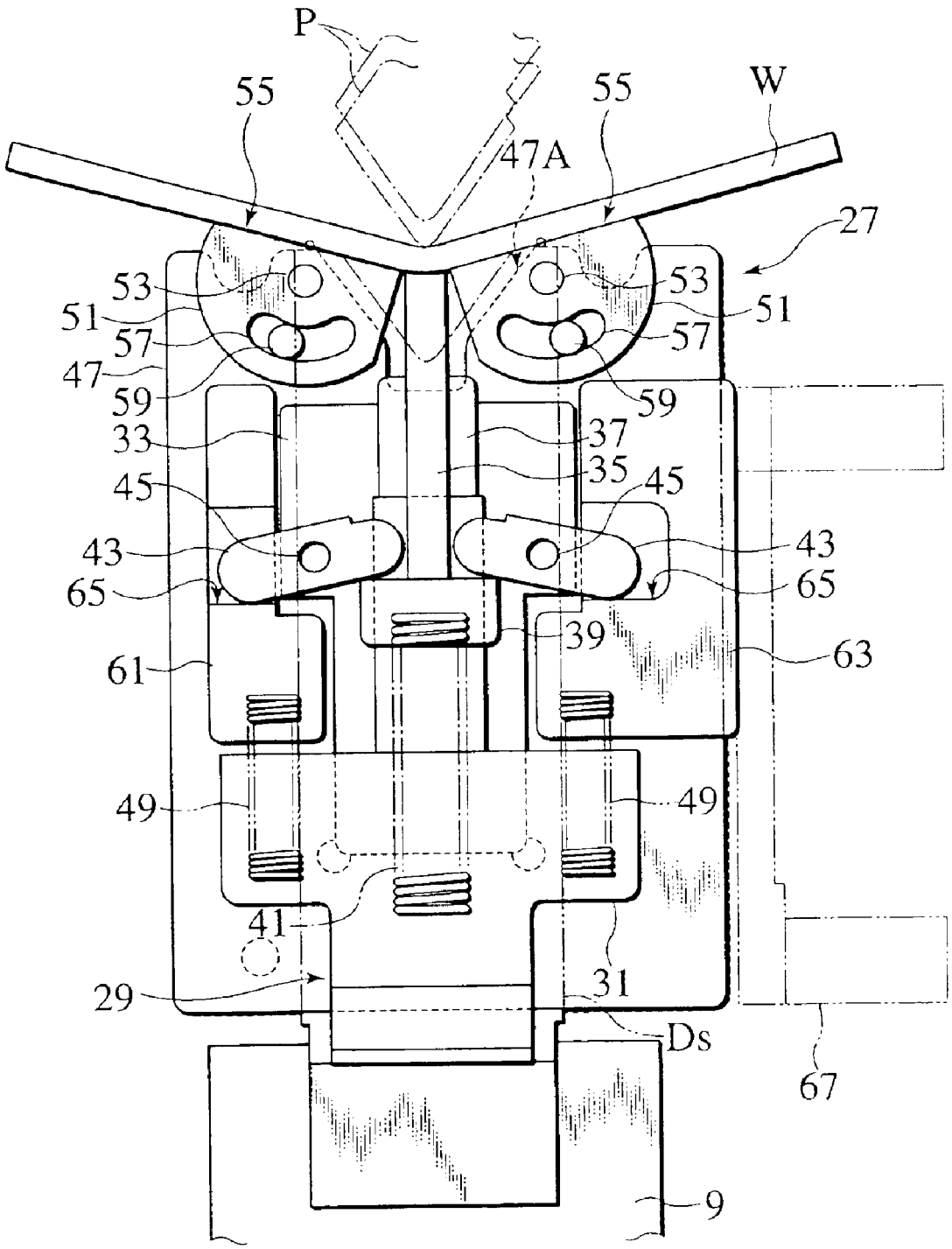
FIG. 3 is a schematic front view of a bending angle detecting device according to a first embodiment of the present invention.

As an arrangement work to be carried out by an operator, when the punches P and die D are mounted according to a shape and a length of a workpiece W, at least one or desirably a plurality of bending angle detecting devices 27 shown in FIG. 3 for detecting a bending angle of the workpiece W are mounted to the gaps between the adjacent divided dies Ds arranged in suitable positions of the die holder 9 in the longitudinal direction.

Figure 1:
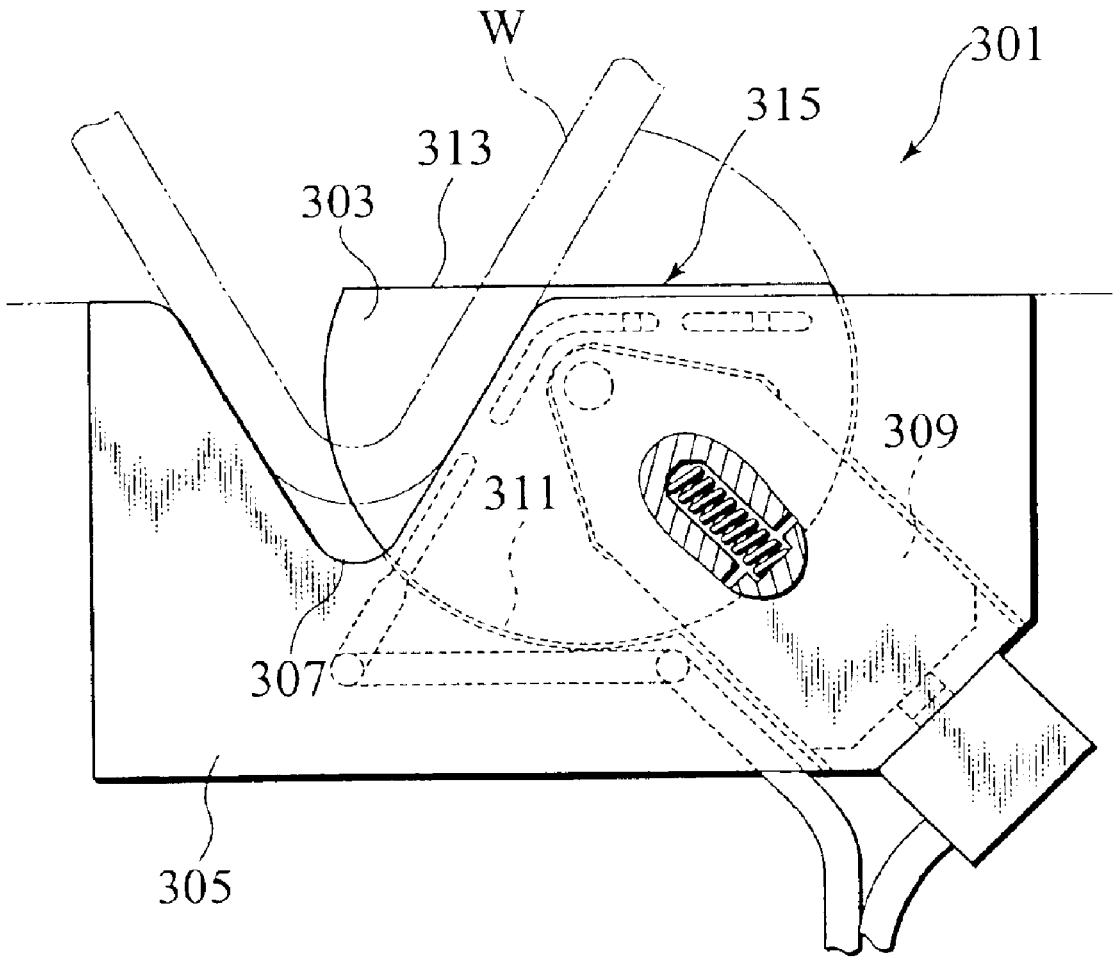
FIG. 1 is a schematic side view of a conventional bending angle detecting device.

With reference to FIGS. 3 and 5, the bending angle detecting device 27 of the first embodiment composing a main section of the present invention is provided with a detecting device main body 29 at the gap between the adjacent divided dies Ds detachably, and a base portion 31 at the lower portion of the detecting device main body 29 can be attached and detached to/from the die holder 9, and, for example, a pin shaft 35 as a lifting member which is guided by a guide section 37 is provided at an approximately center of a supporting section 33 at the upper portion of the detecting device main body 29 so as to be movable up and down. The lower portion of the pin shaft 35 is provided with a first engagement member 39 having engagement portions protruding left and right as shown in FIG. 1, and the pin shaft 35 is normally biased upward with respect to the detection device main body 29 by, for example, a first spring 41, as a first elastic body.

Here, the pin shaft 35 is arranged in an approximately center of a V groove width of the die D so that its forward end can be pressed against the bending portion of the workpiece W to be bent.

In addition, the supporting section 33 of the detecting device main body 29 is provided with link members 43, which are positioned, respectively, on the left and right sides of the pin shaft 35 in FIG. 3 and are engaged with the upper surface of the first engagement member 39, so that the link members 43 can be freely pivoted by link shafts 45. For example, a stopper (not shown) for stopping the pivoting of the link members is provided so that the forward end of the pin shaft 35 is normally stopped in a lightly lower position than the upper surfaces of the divided dies Ds by the link members 43.

In addition, the detecting device main body 29 is provided with a plate-shaped rotor supporting member 47, which has a V-shaped notched portion 47A at its upper portion, on the base portion 31 of the detecting device main body 29 so as to be movable up and down in a state that the rotor supporting member 47 is normally biased upward by, for example, two second springs 49 as second elastic bodies provided on the left and right sides of the first spring 41.

Two approximately semicircular rotors 51 are borne on the left and right upper portions of the V-shaped notched portion 47A of the rotor supporting member 47 by pivots 53. Here, arc linear portions of the rotors 51 are workpiece contact portions 55 which come in contact with the linear portion of the flange section of the workpiece W, and they follow the workpiece W to be bent so as to detect the bending angle. A gap between the pivots 53 of the two rotors 51 is wider than the V groove of the divided dies Ds.

In addition, as shown in FIG. 3, the rotors 51 are provided with slots 57 on concentric circles about the pivots 53, and guide pins 59 which insert into the slots 57 protrude from the rotor supporting member 47. Therefore, the rotors 51 are guided by the guide pins 59, respectively, so as to be capable of rotating stably.

More specifically, for example, left and right engagement members 61 and 63 as second engagement members are mounted integrally with the rotor supporting member 47 so a to be opposed to the left and right of the supporting section 33 of the detecting device main body 29, and the rotor supporting member 47 is normally biased upward by the two left and right second springs 49 provided to the base portion 31 via left and right engagement members 61 and 63, respectively. Here, a total biasing force of the two second springs 49 are weaker than an biasing force of the first spring 41.

In addition, engagement concave portions 65 which are engaged with the link members 43 are provided to the left and right engagement members 61 and 63, respectively. Namely, in FIG. 3, the centers of the link members 43 are normally biased upward about the link shafts 45 by the first spring 41 via the first engagement member 39 of the pin shaft 35, and the right and left outer sides of the link members 43 in FIG. 3 are normally biased upward by the second springs 49 via the engagement concave portions 65 of the left and the right engagement members 61 and 63. Since the biasing force of the first spring 41 is stronger, the pin shaft 35 is normally positioned on the lifting end, and the left and right engagement members 61 and 63 are pressurized by the link members 43 so as to be positioned on the lowering end, in other words, the rotor supporting member 47 is positioned at the lowering end.

At this time, the press brake 1 is in the state before starting the bending, namely, the forward end of the pin shaft 35 is positioned slightly below the upper surface of the die D at the lifting end of the pin shaft 35, and the workpiece contact portions 55 of the two left and right rotors 51 retreat below the upper surfaces of the divided dies Ds at the lowering end of the rotor supporting member 47.

Here, the pin shaft 35, the first spring 41, the two second springs 49 the rotor supporting member 47 and the two rotors 51 as well as the detecting device main body 29 can be inserted or detached into/from the gap between the adjacent divided dies Ds as shown in FIG. 5.

Figure 4:
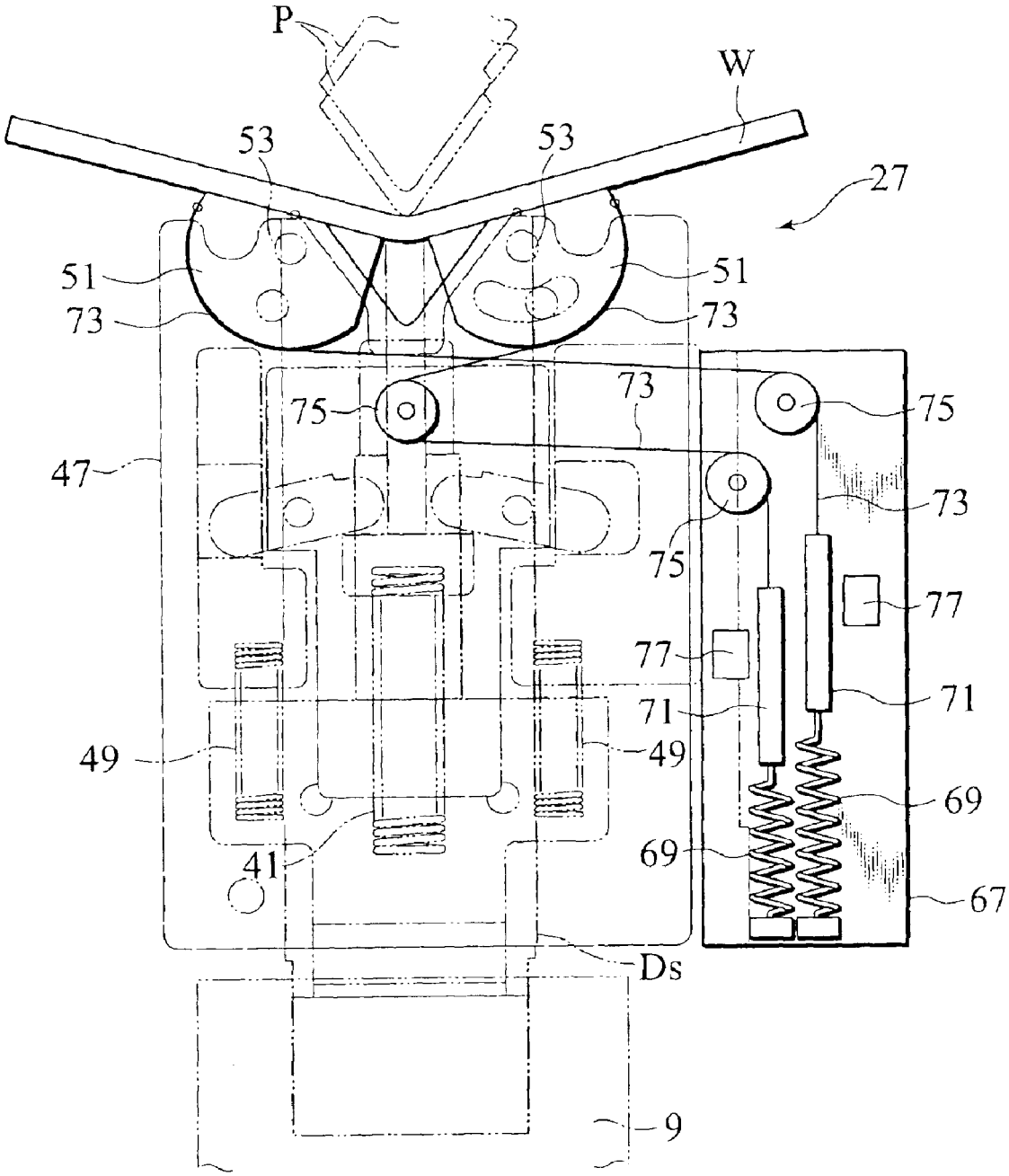
FIG. 4 is a schematic front view showing an apparatus for reading a rotating amount of a rotor of the bending angle detecting device in FIG. 3.

With reference to FIG. 4, in the present embodiment in which an auxiliary base 67 is positioned on the outside of the divided dies Ds and is mounted integrally with the rotor supporting member 47 in the detecting device main body 29. One end of a tension spring 69 is mounted to a lower portion of the auxiliary base 67 and a linear scale 71 is fixed to the other end of the tension spring 69, and one end of a wire 73, for example, as a linear element is fixed to an outer peripheral surface of the rotor 51 from the upper end of the linear scale 71 via a plurality of wheels 75 in a state that, for example, the wire 73 is wound by ¼ and half windings around the outer peripheral surfaces of the rotor 51. The other rotor 51 has the similar structure, and FIG. 4 show the wire 73 and the plural wheels 75, but since a phase of this wire 73 shifts from that of the other wire 73 of one rotor 51, the rotors 53 do not interfere with each other. The wheel 75 at the center in FIG. 4 is mounted to the outside of the guide section 37, namely, on this side with respect to the sheet surface of FIG. 4.

Therefore, since the two rotors 51 are normally drawn downward by the tension springs 69, they are stopped by the guide pin 59 and the slot 57 so that the arc portions of the rotors 51 are positioned horizontally in the normal state.

Figure 6:
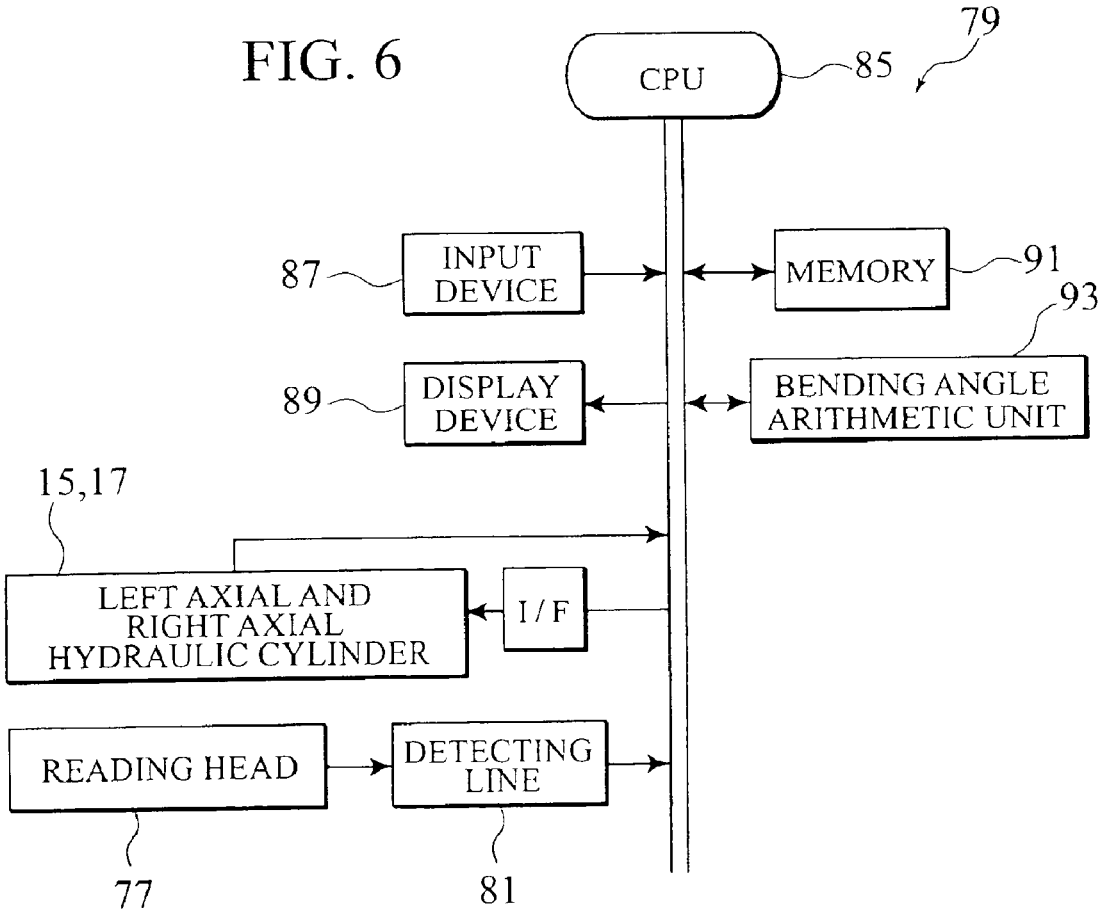
FIG. 6 is a structural block diagram of a control device.

In addition, for example, reading heads 77 as scale moving amount detecting devices for detecting a moving amount of the linear scales 71 are mounted to the vicinities of the linear scales 71, respectively, in the auxiliary base 67, and the reading heads 7 are connected with a control device 79 as shown in FIG. 6.

With the above structure, as the workpiece W is being bent by the cooperation of the punches P and the divided dies Ds, the two rotors 51 pivot according to the bending state of the workpiece W. Accordingly the wires 73 are drawn against the biasing forces of the tension springs 69, so that the linear scales 71 lifts. The moving amounts of the linear scales 71 are read by the reading heads 77 so that rotating amounts of the rotors 51 are detected, and the bending angle of the workpiece W is calculated by the control device 79 and instantly detected.

With reference to FIG. 5, a detecting line 81 which is connected with the control device 79 is wired on a bottom portion of the die holder 9. Since a signal line terminal 83 which is connected with the reading heads 77 is provided to the lower portion of the detecting device main body 29 of the bending angle detecting device 27 so as to be capable of coming in contact with the detecting line 81, the bending angle detecting device 27 can be inserted and easily mounted into the gap between the adjacent divided dies Ds with suitable interval so as to be capable of measuring an angle of at least one portion, desirably plural portions in the longitudinal direction of the workpiece W.

With reference to FIG. 6, in the control device 79, a CPU 85 as a central processing unit is connected with an input device 87 as bending condition input means for inputting data such as a material, a plate thickness, a working shape, a mold condition, a target bending angle and a working program of the workpiece W, a display device 89 as a CRT display and a memory 91 for storing the input data.

In addition, the CPU 85 is connected with a bending angle arithmetic unit 93 for calculating the bending angle based on signals from the reading heads 77 which read moving amounts of the linear scales 71 of the respective bending angle detecting devices 27.

Next, the operation of the bending angle detecting device 27 having the above structure will be explained below with reference to the drawings.

Step S1 (At the time of locating the workpiece W, the angle of the workpiece W is 180°)

Figure 7A:
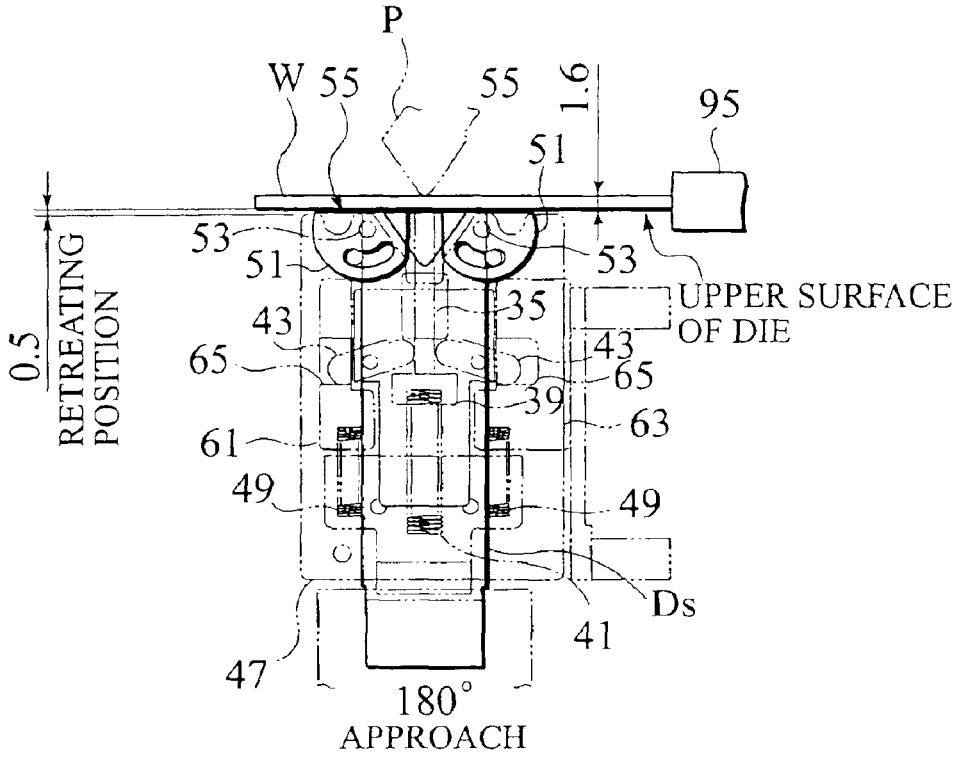
FIGS. 7A, 7B, 8C and 8D are operation explanatory diagrams of the bending angle detecting device.

With reference to FIG. 7A, when the workpiece W is placed on the divided dies Ds and is butted against a butting portion of a back gauge 95 so as to be located, as mentioned above, the pin shaft 35 is positioned on the lifting end by the biasing force of the first spring 41, and the end of the pin shaft 35 is positioned slightly below the upper surface of the die D, and the rotor supporting member 47 is pressurized downward against the biasing forces of the two second springs 49 via the first engagement member 39 of the pin shaft 35, the link members 43 and the engagement concave portions 65 of the left and right engagement members 61 and 63. For this reason, the workpiece contact portions 55 of the two rotors 51 are retreated downward by, for example, about 0.5 mm from the upper surface of the die D. Therefore, before starting the bending, when the workpiece W is carried onto the divided dies Ds, the workpiece W does not interfere with the two rotors 51, so that the workpiece W is located smoothly.

Incidentally, when the workpiece contact portions 55 of the rotors 51 are positioned above the upper surfaces of the divided dies Ds, the workpiece W interferes with the rotors 51, and thus while the workpiece W is being slid on the divided dies Ds, it cannot be butted against the butting portion of the back gauge 95.

Step S2 (At the time of the initial bending, the angle of the workpiece W is in the vicinity of 170°)

Figure 7B:
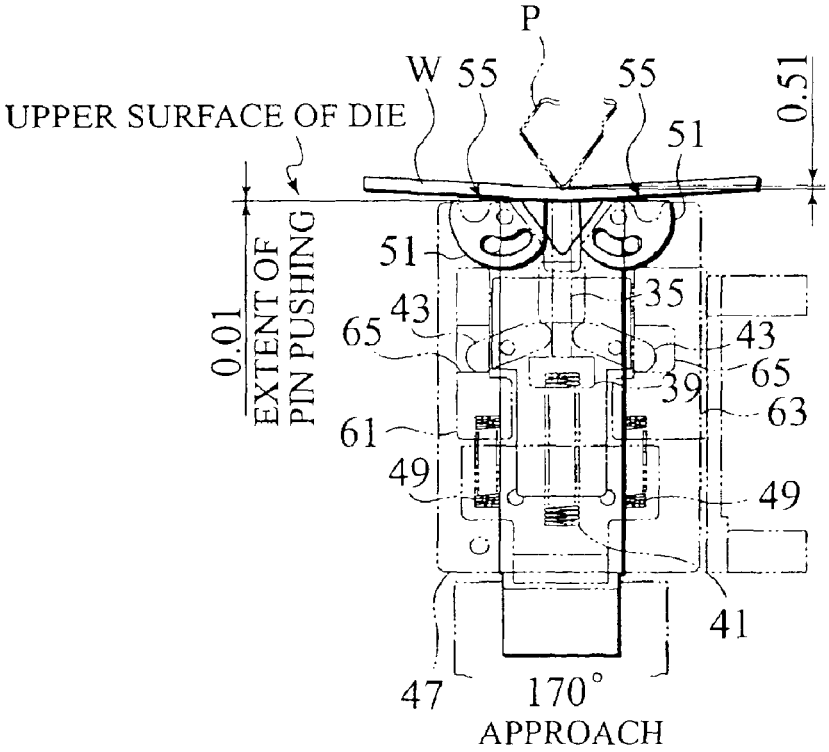

With reference to FIG. 7B, as the punches P start to lower and the bending progresses, when the bending linear portion of the workpiece W pushes down the pin shaft 35 against the biasing force of the first spring 41, the first engagement member 39 lowers. For this reason, the link members 43 pivot so that the left and right engagement members 63 lift by means of the biasing forces of the second springs 49. Therefore, since the left and right engagement members 63 lift, the rotor supporting member 47 lifts. When the bending angle of the workpiece W is about 170°, the workpiece W pushes the pin shaft 35 by 0.01 mm, namely, the so-called extent of pushing is 0.01 mm, but since the center portions of the workpiece contact portions 55 of the rotors 51 do not yet come in contact with the workpiece W, the bending angle of the workpiece W is not detected. This is the approaching stage.

Step S3 (at the tme of initial bending, the angle of the workpiece W is in the vicinity of 160°)

Figure 8C:
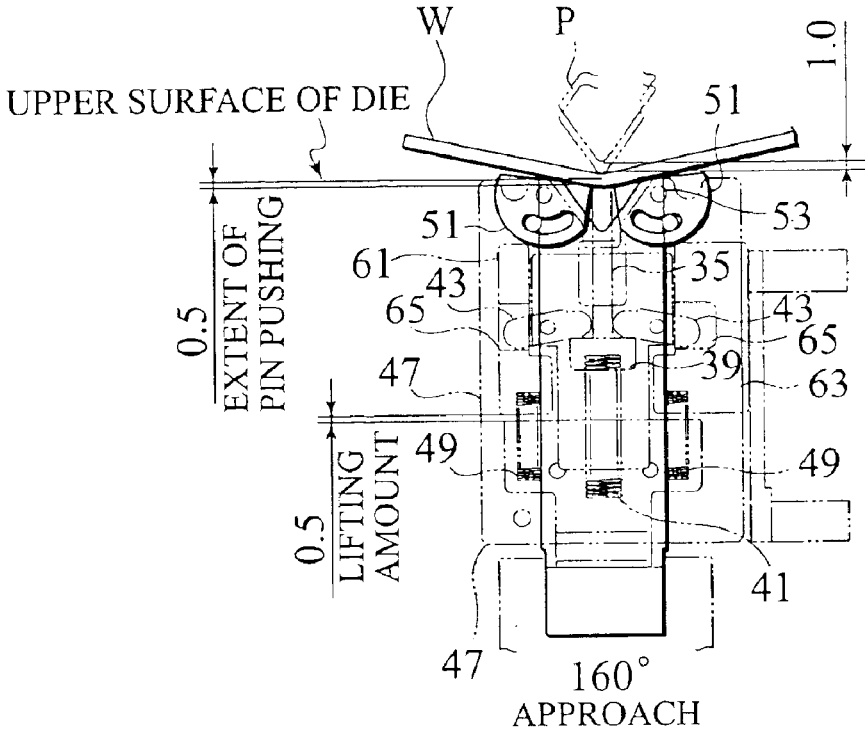

With reference to FIG. 8C, when the lifting of the punches P further progresses, the bending linear portion of the workpiece W comes in contact with the forward end surface of the pin shaft 35, and when the pin shaft 35 is pushed by about 0.5 mm, the link members 43 further pivot due to the lowering of the first engagement member 39, and the rotor supporting member 47 lifts due to the biasing forces of the second springs 49. The lift amount is 0.5 mm. However, when the extent of pushing is 0.5 mm and the lift amount is 0.5 mm, the workpiece contact portions 55 of the rotors 51 are flush with the upper surface of the die D, and since the the rotors 51 do not follow the linear portion of the flange portion of the workpiece W, the contact between the rotors 51 and the workpiece W is not sufficient similarly to step S2, so that the angle of the workpiece cannot be detected by the rotors 51. This is the approaching stage.

Step S4 (at the initial bending, the angle of the workpiece W is in the vicinity of 150°)

Figure 8D:
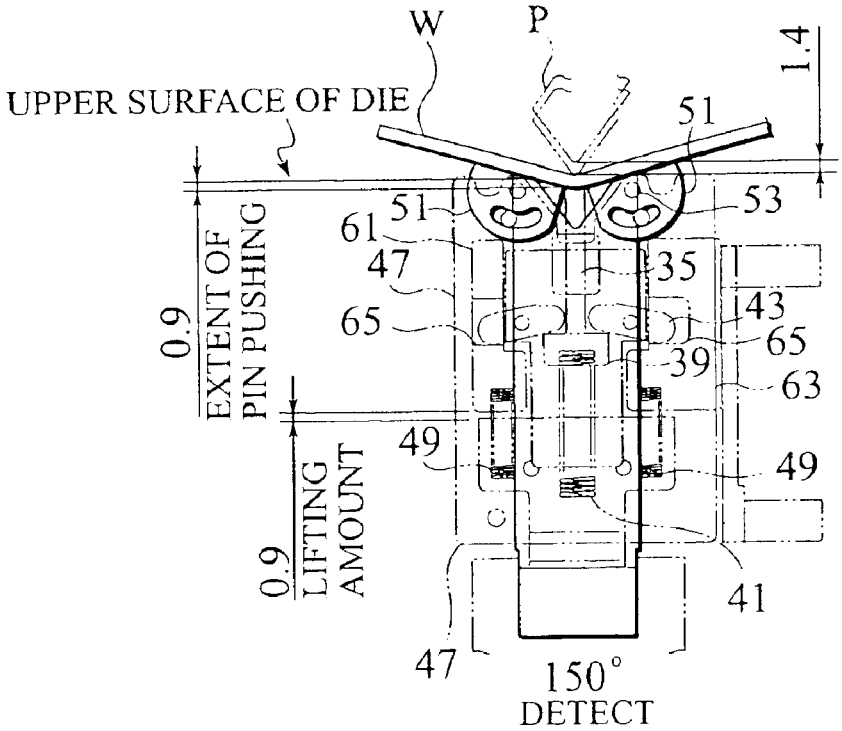

With reference to FIG. 8D, when the punches P is further lowered and the forward end surface of the pin shaft 35 is pushed by about 0.9 mm by the bending linear portion of the workpiece W, the rotor supporting member 33 lifts entirely by 0.9 mm, so that the workpiece contact portions 55 of the two rotors 51 also protrude above the die. Thereafter, since the rotors completely follow and come in contact with the linear portion of the flange portion of the workpiece W so as to be rotated, the rotating angles are calculated by the bending angle arithmetic unit 93 so that the bending angle of the workpiece is detected. This is the bending angle detecting stage.

Step S5 (at the time of initial bending, the angle of the workpiece W is in the vicinity of 120°)

Figure 9E:
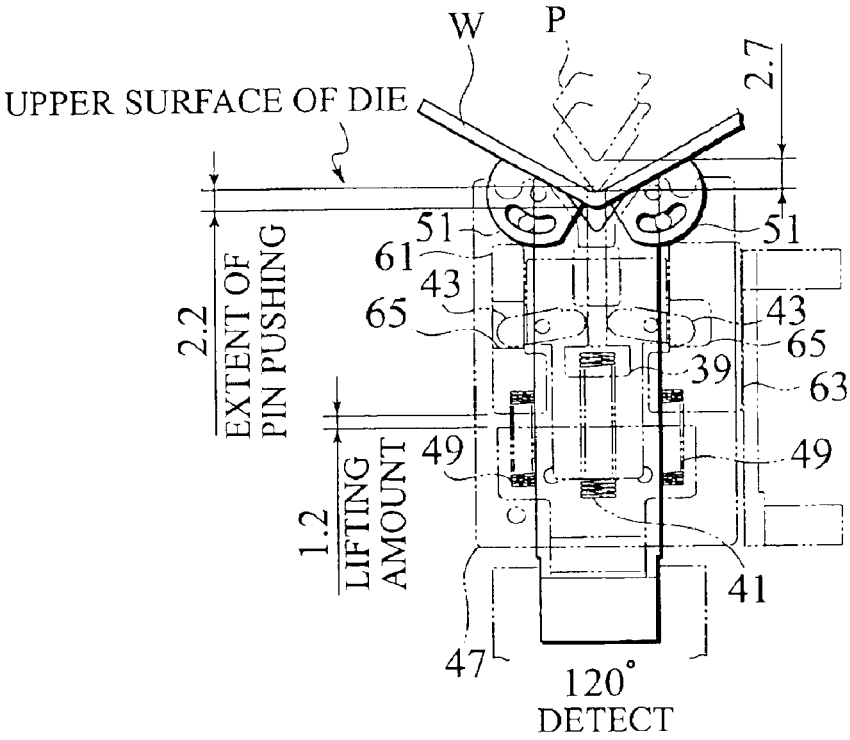
FIGS. 9E and 9F are operation explanatory diagrams following FIG. 8D.

With reference to FIG. 9E, although the punches P are further lowered and the forward end surface of the pin shaft 35 is pushed dow by 2.2 mm by the bending linear portion of the workpiece W, the rotor supporting member 33 is pressed downward via the rotors 51 by a repulsive force of the workpiece W so as to be lifted only by 1.2 mm. However, the outsides of the rotors 51 further rotate to move upward on the upper surfaces of the divided dies Ds and the rotors 51 follow the leap-up of the flange portion of the workpiece W, and the arc linear portions as the workpiece contact portions 55 of the rotors 51 come in contact with the linear portion of the workpiece W so that the bending angle of the workpiece W is calculated accurately. This is the bending angle detecting stage.

Step S6 (at the time of final bending, the angle of the workpiece W is in the vicinity of 90°)

Figure 9F:
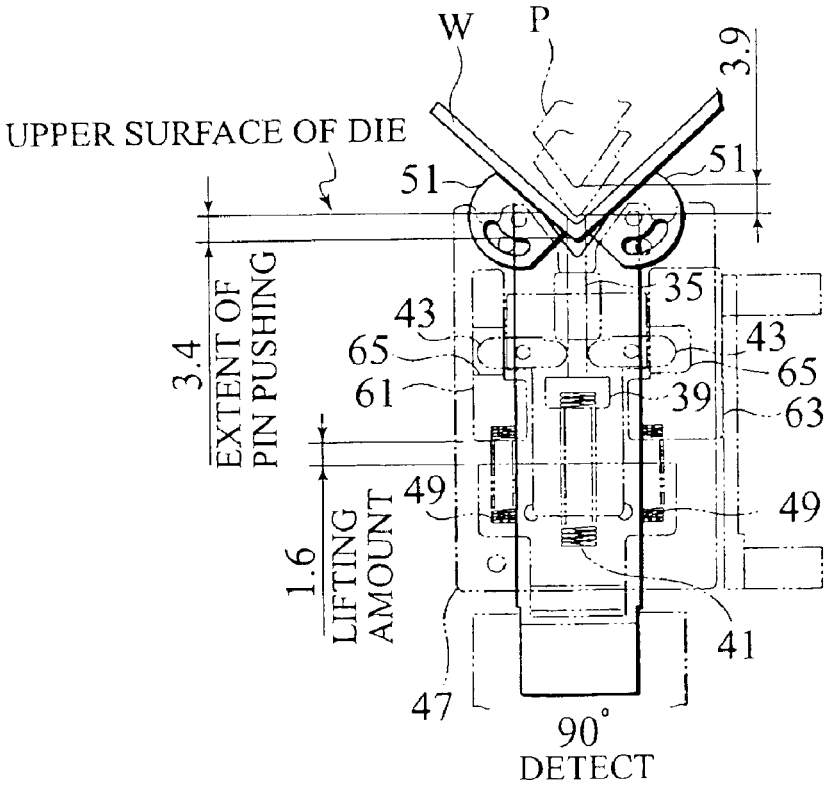

With reference to FIG. 9F, although the punches P are further lowered and the forward end surface of the pin shaft 35 is pushed down by about 3.4 mm by the bending linear portion of the workpiece W, the rotor supporting member 33 is pressed downward via the rotors 51 by the repulsive force of the workpiece W so as to be lifted only by 1.6 mm. However, the outsides of the rotors 51 further rotate to move upward on the upper surface of the die similarly to the step S5, and the rotors 51 follow the leap-up of the flange portion of the workpiece W, and the arc linear portions as the workpiece contact portions 55 of the rotors 51 come in contact with the linear portion of the workpiece W, so that the bending angle of the workpiece W is calculated accurately.

After the bending is completed, when the workpiece W is removed from the divided dies Ds, the pin shaft 35 lifts due to the biasing force of the first spring 41 so as to return to the original point at the lifting end. Thereafter, since the first engagement member 39 of the pin shaft 35 lifts, the link members 43 pivot to the opposite direction to the pivoting direction at the time of the bending. For this reason, the left and right engagement members 61 and 63 which are engaged with the link members 43 are lowered against the biasing forces of the second spring 49 so as to return to the original position at the lower end. Namely, the state returns to one shown in FIG. 7A.

As mentioned above, since the two rotors 51 exist on the rotor supporting member 47, the bending angle is detected by at least one bending angle detecting device 27. Further, since the operation of the rotors 51 is only the rotation, the structure of the rotors 51 as the angle detecting sections is simplified and thus the measurement is made by the two rotors 51 so that the measuring accuracy is improved.

In addition, since the leap-up following mechanism of the workpiece W by means of the two rotors 51 is the spring elements such as the first and second springs 41 and 49, the rotors 51 respond to the movement of the workpiece W flexibly and instantly. Although the workpiece W is bent unstably with a certain tilt due to, for example, a difference in sliding conditions of the die shoulder R, since the two rotors 51 are arranged on the one rotor supporting member 47, the two rotors 51 follow the tilt at the process for bending the workpiece W. For this reason, the bending angle detecting device 27 is composed for each rotor 51 without separating them.

As a result of the above explanation, the bending angle of the workpiece can be detected easily and accurately even at the bending which is carrie out a mold having a V groove with an unbalance angle, a mold or the like in which R of different V-groove shoulder portion is arranged.

In addition, since the gap between the pivots 53 of the two rotors 51 is wider than the groove width of the divided dies Ds, the bending angle of the workpiece W is detected on the outside of the groove width of the divided dies Ds, and the linear portion of the flange portion of the workpiece W excluding the bending R portion is measured so that the measurement is made accurately and a detection error is reduced. Therefore, the bending angle detecting device 27 does not depend upon mold conditions such as the groove width of the divided Dies Ds and R of the groove shoulder, namely, is independent.

In addition, since the rotors 51 have a semicircular shape and is provided with the arc linear type workpiece contact portions 55, the rotors 51 easily rotate so that the structure is simplified and thus the the linear workpiece contact portions 55 easily follow the linear portion of the workpiece W.

Figure 10:
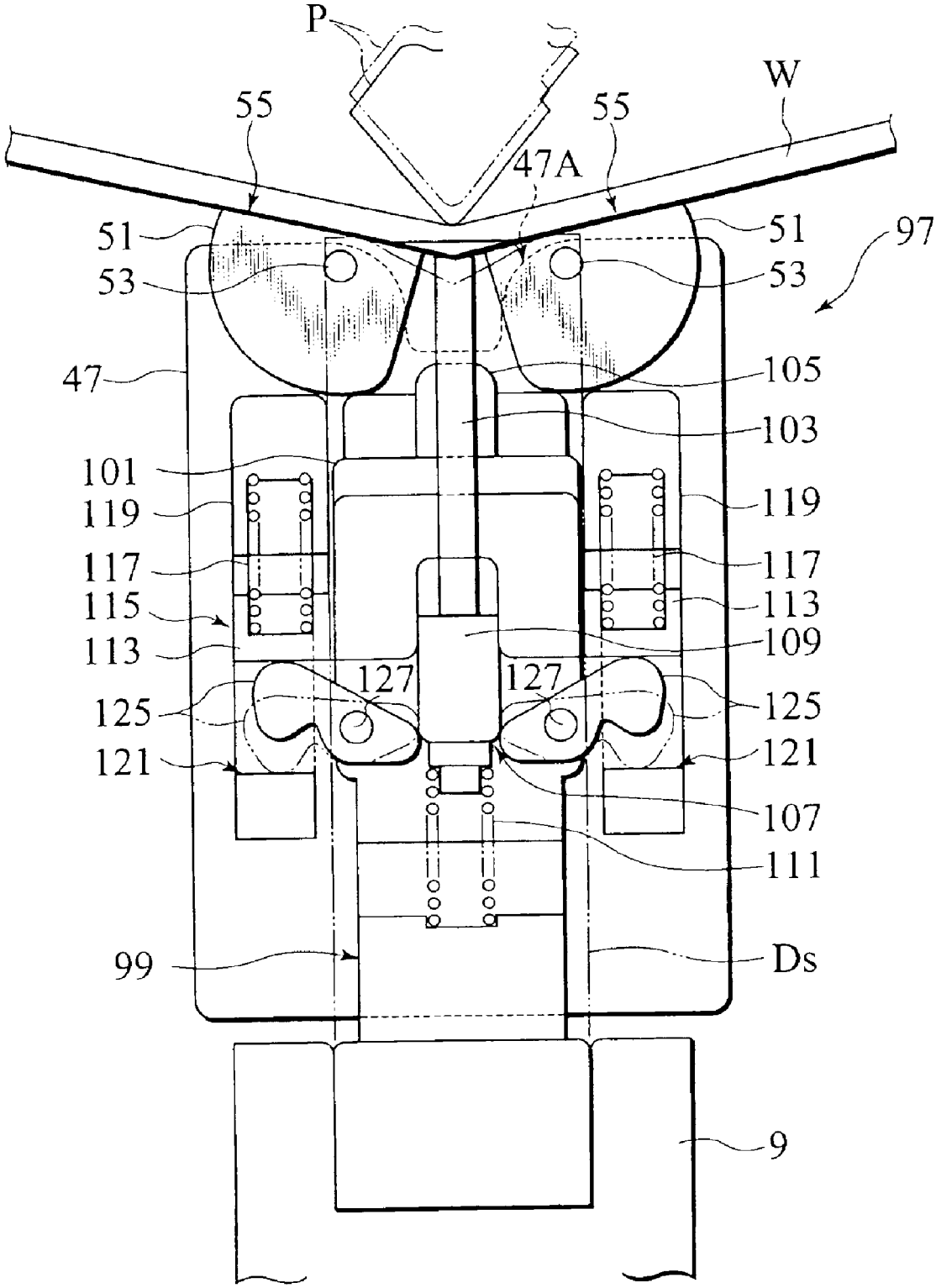
FIG. 10 is a schematic front view of the bending angle detecting device according to a second embodiment of the present invention.
Figure 11:
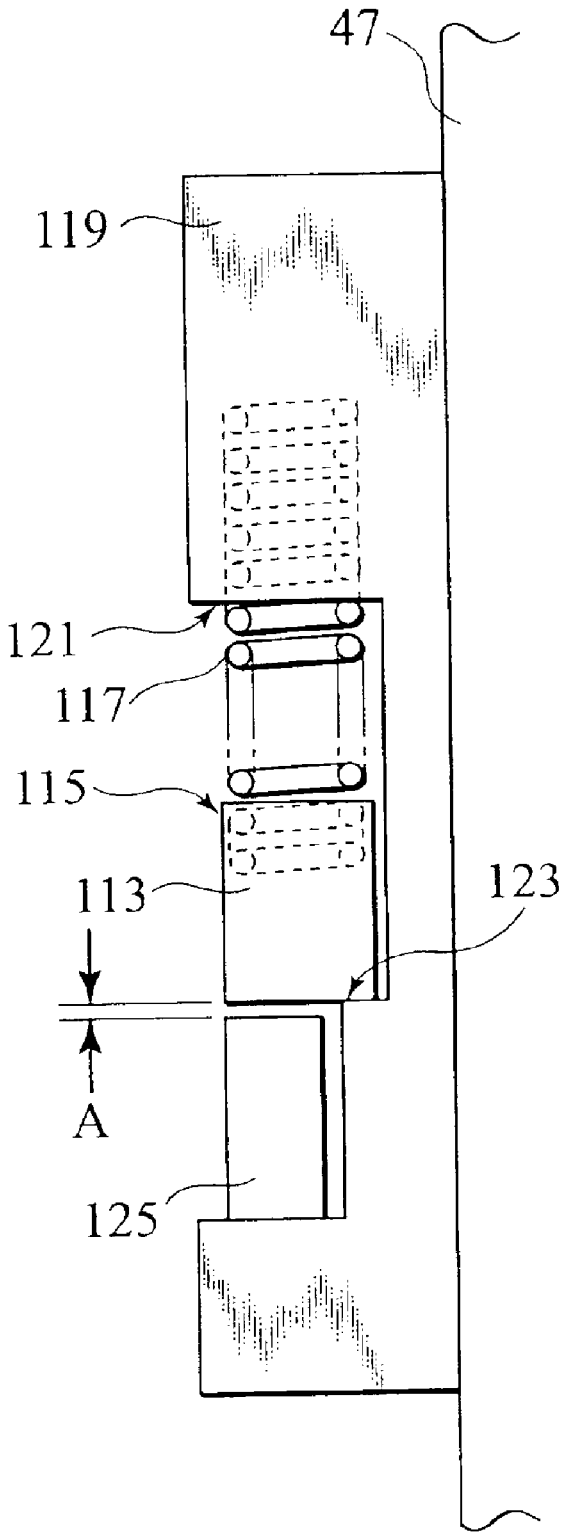
FIG. 11 is a right side view of a part of the bending angle detecting device in FIG. 10.

With reference to FIGS. 10 and 11, a bending angle detecting device 97 of a second embodiment composing the main section of the present invention will be explained in a manner that like members are designated by like numbers of the bending angle detecting device 27 of the first embodiment.

In the bending angle detecting device 97, a detecting device main body 99 can be inserted into and detached from the gap between the adjacent divided dies Ds similarly to the first embodiment, and it can be attached/detached to/from the die holder 9. The approximately center of an upper supporting section 101 of the detecting device main body 99 is provided with, for example, a pin shaft 103 as the lifting-lowering member via a guide section 105 so that the pin shaft 103 is movable up and down. Moreover, the pin shaft 103 is arranged so that its forward end is pressed against the bending portion of the workpiece W.

The lower portion of the pin shaft 103 is provided with a link engagement member 109 having, for example, a taper pressurizing section 107 as the engagement section at its left and right sides in FIG. 10, and the pin shaft 103 is normally biased upward with respect to the detecting device main body 99 by a first spring 111 as a first elastic body. However, the forward end of the pin shaft 103 is stopped in a position slightly lower than the upper surfaces of the divided dies Ds.

In FIG. 10, a damper buffer member 115 having flange portions 113 on its left and right sides, respectively, is provided so as to slide the outer peripheral surface of the pin shaft 103 and freely lift and lower. On the left and right flange portions 113 of the damper buffer member 115, guide members 119 which are normally biased by, for example, damper springs 117 as two damper elastic bodies are provided on the left and right, respectively.

As shown in FIG. 11, the guide members 119 is provided with notched portions 121, respectively, and the flange portions 113 of the damper buffer member 15 enter the notched portions, respectively, and the damper springs 117 are provided between the flange portions 113 and the upper surfaces of the notched portions 121 of the guide members 119. Therefore, an biasing force acts upon the flange portions 113 and the guide members 119 of the damper buffer member 115 to their repulsing direction due to the damper springs 117, but the insides of the notched portions 121 are formed with, for example, stepped portions 123 as stopper sections for constantly restraining the gaps between the damper buffer member 115 and the guide members 119 in the repulsing direction.

The two left and right guide members 119 are provided integrally with a rotor supporting member 47 similarly to the first embodiment. The rotor supporting member 47 has a plate shape, and as shown in FIGS. 8 and 9, its upper portion has an approximately V shaped notched portion 47A.

The rotor supporting member 47 bears the two approximately semicircular rotors 51 on the left and right upper portions of the V-shaped notched portion 47A, respectively, using the pivots 53. Here, since the bending angle arithmetic unit 93 for detecting the bending angle after the rotors 51 follow the workpiece to be bent and its function are similar to those in the first embodiment, the explanation thereof is omitted.

In addition, the supporting section 101 of the detecting device main body 99 is provided with link members 125 which are positioned on the left and right sides of the pin shaft 103 in FIG. 8 and whose one ends are engaged with the taper pressurizing sections 107 of the link engagement member 109 so that the link members 125 freely pivot by means of link shafts 127. The lower surfaces of the flange portions 113 of the damper buffer member 115 are placed on the other ends of the two left and right link members 125.

Therefore, the upper surfaces including the other ends of the two left and right link members 125 are normally in the approximately horizontal state, and the rotor supporting member 47, which is integral with the guide members 119 in which the flange portions 113 of the damper buffer member 115 are housed in the notched portions 121 via the damper springs 117, is lifted by the upper surfaces of the two left and right link members 125.

With the above structure, when the workpiece W is placed on the divided dies Ds, the pin shaft 103 is positioned on the lift end by the biasing force of the first spring 111 so that the forward end of the pin shaft 103 is positioned slightly below the upper surfaces of the divided dies Ds.

As the punches P start to lower and the workpiece W is being bent by the cooperation of the punches P and the divided dies Ds, when the bending linear portion of the workpiece W pushes down the pin shaft 103 against the biasing force of the first spring 111, the link engagement member 109 lowers, and the taper pressurizing sections 107 pressurize the one ends of the link members 125 downward and the other ends of the link members 125 are pivoted to the direction where they lift. Therefore, since the damper buffer member 115 lifts due to the other ends of the link members 125, the rotor supporting member 47 which is integral with the guide members 119 via the damper springs 117 lifts.

Here, after the link members 125 are pivoted through a constant angle as shown by solid lines of FIG. 10 by the taper pressurizing sections 107 of the link engagement member 109, the link members 125 slide on the linear portion on the outer periphery of the link engagement member 109, namely, make "sliding move". For this reason, the link members 125 are held at a constant lift amount regardless of the extent of pushing of the pin shaft 103, in other words, a lowering amount.

When the rotor supporting member 47 lifts, the workpiece contact portions 55 of the two rotors 51 butt against the flange portion of the workpiece W so as to pivot according to the bending states of the workpiece W.

At this time, after the rotors 51 butt against the workpiece W, when the damper buffer member 115 is lifted by the link members 125, the two damper springs 117 function as damper. Namely, a speed at which bending linear portion of the workpiece W pushes down the pin shaft 103 according to the progress of the bending, in other words, a lift speed of the damper buffer member 115 lifting via the link members 125 is different from a speed at which the flange portion of the workplaces W leaps up, but the two damper springs 17 function as damper so as to absorb the lift difference. For this reason, the two rotors 51 follow the bending angle of the workpiece W securely so as to rotate.

The rotating angle of the two rotors 51 is converted into the bending angle of the workpiece W by the bending angle arithmetic unit 27 so as to be detected instantly and accurately similarly to the first embodiment.

After the bending is completed, when the workpiece W is removed, the pin shaft 103 is lifted by the first spring 111 and the damper buffer member 115 is pushed down by the biasing forces of the two damper springs 117, so that the two link members 125 are pivoted to the direction where they return to the original position.

At this time, before the link members 125 returns to the approximately horizontal position, the biasing forces of the damper springs 117 which pushes down the damper buffer member 115 are restrained by the stepped portion 123, so that the forces which push down the link members 125 are stopped by the damper buffer member 115. As shown in FIG. 11, since a gap A is generated between the lower surfaces of the flange portions 113 of the damper buffer member 115 and the upper surfaces of the link members 125, the link members 125 are prevented from interfering with the damper buffer member 115.

Here, a different point from the first embodiment is that since the lowering operation of the pin shaft 103 can enlarge the lift width of the rotor supporting member 47 by utilizing moments of the link members 125, the two second spring 49 of the first embodiment are not necessary, so that it is not necessary to further strengthen the biasing force of the first spring 111. As a result, the size of the first spring 111 can be greatly compact. Accordingly, there is a merit that the entire bending angle detecting device 97 can be compact.

Incidentally, in the case of the first embodiment, since the first spring 111 requires the biasing force stronger than that of the left and right second springs 49 in order to return the pin shaft 103 to the original position, the size of the first spring 111 becomes large necessarily.

From the above explanation, in any one of the first and second embodiments, since the following mechanism composed of the two rotors is the spring element such as the second springs 49 and the damper springs 117, the following mechanism responds to the leap-up operation of the flange portion of the workpiece W flexibly and instantly.

Thereafter, as a third embodiment of the present invention, the bending method in the bending apparatus and the apparatus thereof will be explained below with reference to the drawings by exemplifying the hydraulic press brake as the press brake.

Figure 12:
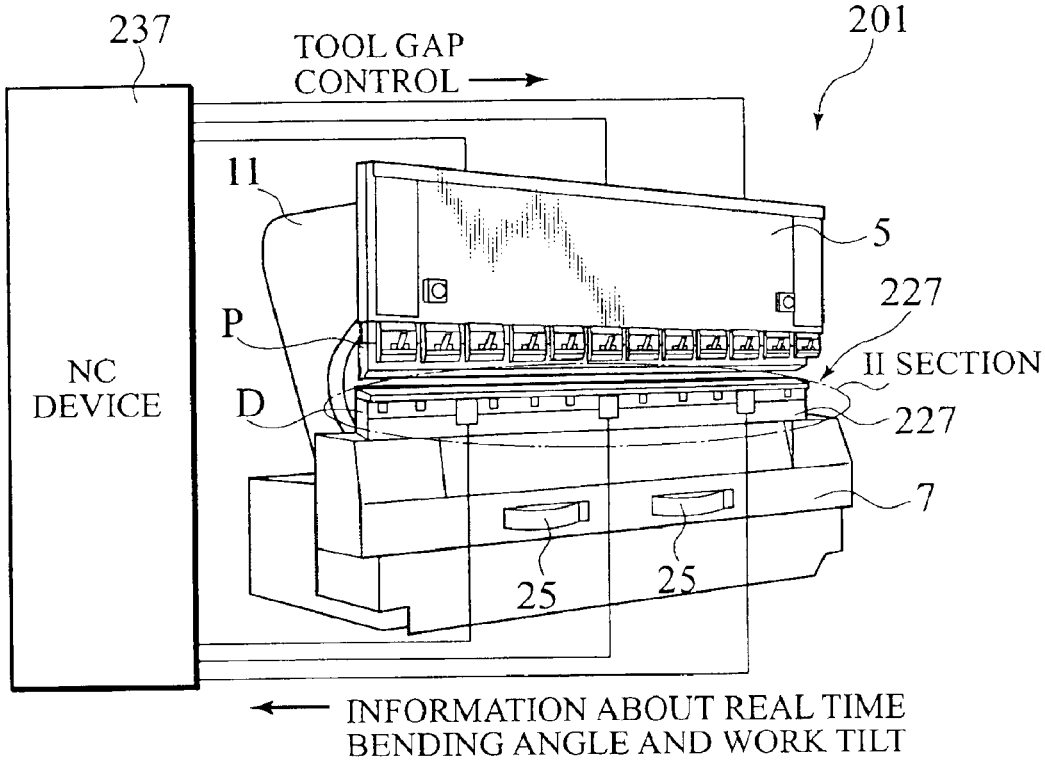
FIG. 12 is a general perspective view of the press brake according to a third embodiment of the present invention.

With reference to FIGS. 2 and 12, a press brake 201 of the present embodiment refers to the lowering type hydraulic press brake, but a lifting type press brake or a mechanical press brake such as crank which is not of the hydraulic type may be used.

The lowering type hydraulic press brake 1 is mounted and fixed to the lower surface of, for example, the upper table 5 as a movable table movable up and down, namely a ram, via a plurality of intermediate plates 3 where the punches P are arrange with equal intervals. The die D is mounted and fixed to the upper surface of, for example, the lower table 7 as a fixed table via a die holder 9. Therefore, the upper table 5 lowers and the workpiece W as a plate material is bent between the punches P and the die D by the cooperation of the punches P and the die D.

The left axial and right axial hydraulic cylinders 15 and 17 are provided to the upper portions of the left and right side frames 11 and 13 in FIG. 2 composing the main body frame, and the upper table 5 is joined to the lower ends of the piston rods 19 of the left axial and right axial hydraulic cylinders 15 and 17.

In addition, the lower table 7 is fixed to the lower portions of the left and right side frames 11 and 13, and the notched portions 21 are provided to the center portion of the lower table 7, and, for example, the crowning cylinders 23 and 25 (hydraulic cylinders) as the crowning device are provided in the notched portions 21, respectively. Pressurizing forces of pistons of the crowning cylinders 23 and 25 are controlled, so that a deflection amount of the center portion of the lower table 7 is adjusted.

Figure 13:
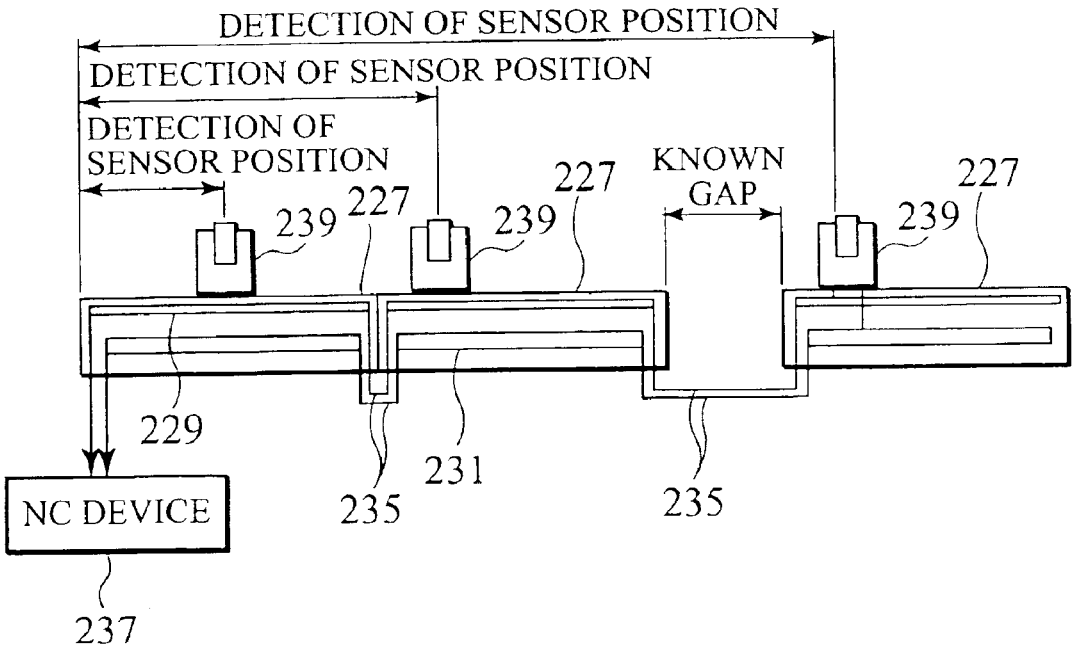
FIG. 13 is a mimetic diagram showing a detail of II portion of FIG. 12.

As shown in FIGS. 2 and 13, the lower table 7 is joined to a plurality of divided die holders 9 so that a network die holder 227 is structured. Two rail electrodes composed of a resistance rail electrode (Power) 229 and a copper rail electrodes 231 are wired on the bottom portion of the network die holder 227 approximately parallel, so that a part of a position detecting device 233 is structured. As for joints of the die holders 9, the resistance rail electrodes 229 of the adjacent die holders 9 are connected with each other and the copper rail electrodes 231 of the adjacent die holders 9 are connected with each other by connection cables 235. Here, one end sides of the resistance rail electrodes 229 and one end sides of the copper rail electrodes 231 are connected with a control device 237 by an NC device or the like.

Figure 16:
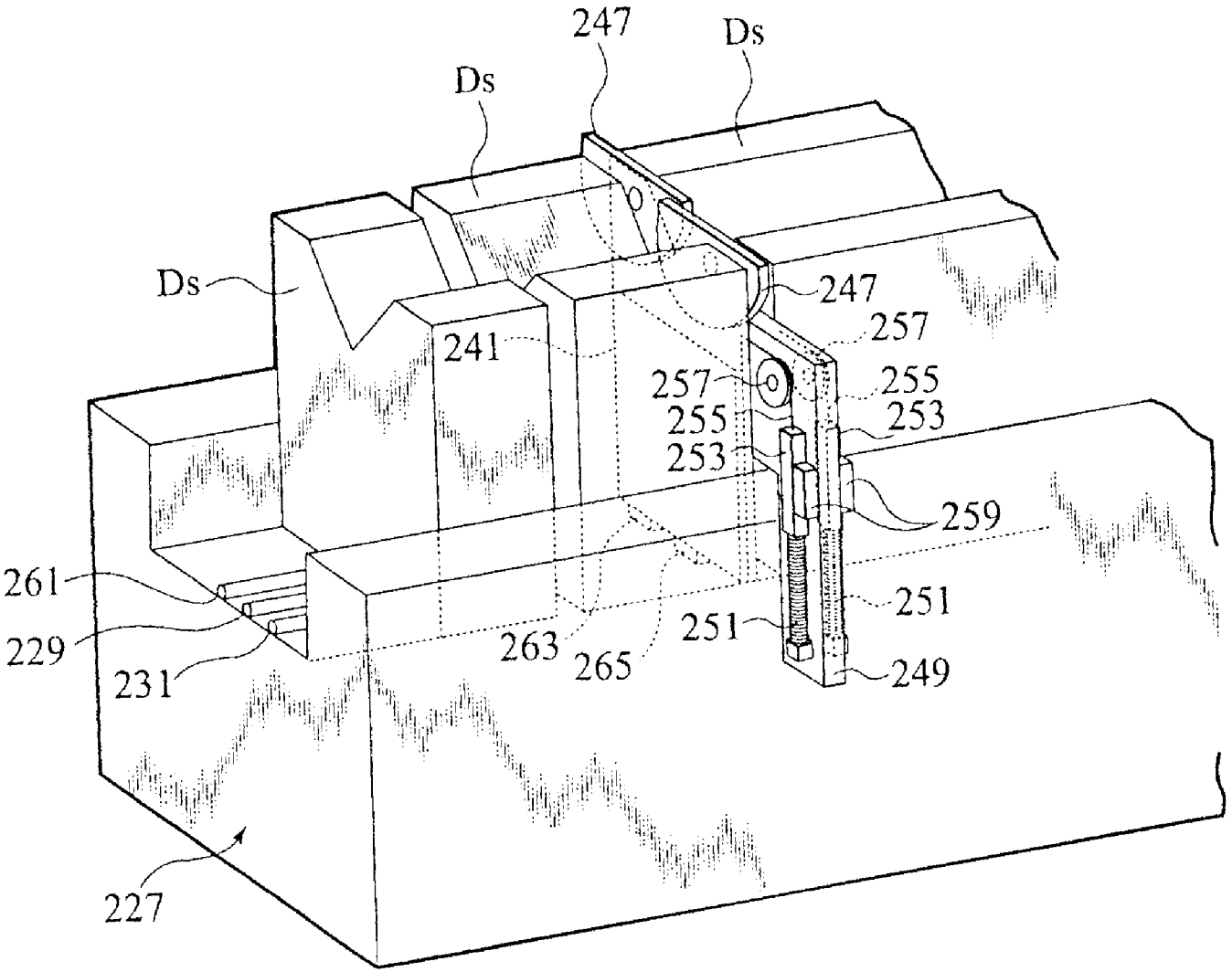
FIG. 16 is a state explanatory diagram in which the angle sensor unit to be used in the embodiment of the present invention is installed.

In addition, the die D of the present embodiment is constituted so that the divided dies Ds are combine and joined as shown in FIG. 16 and the die D is mounted to the network die holder 227.

Figure 15:
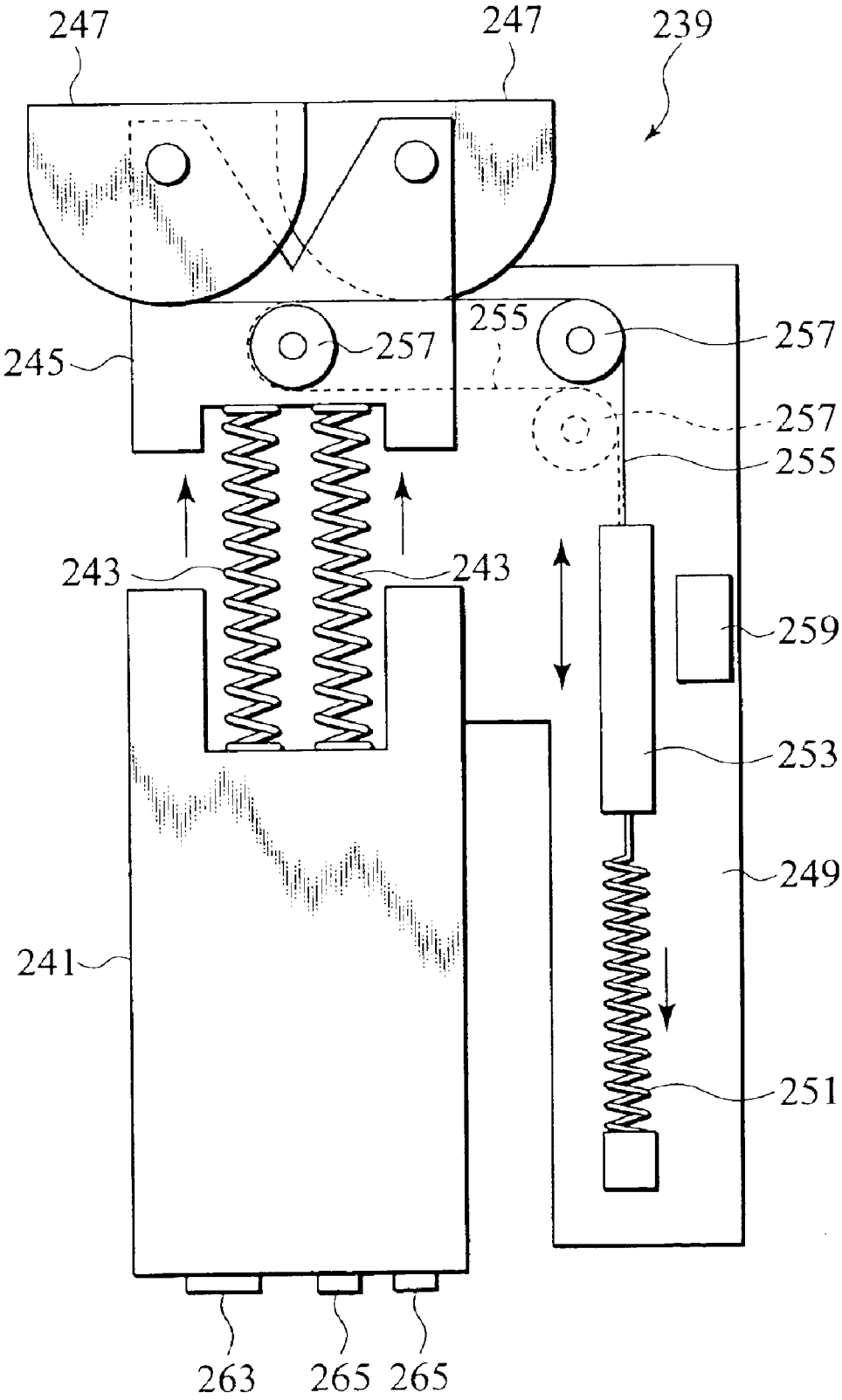
FIG. 15 is a mimetic diagram of the angle sensor unit to be used in the embodiment of the present invention.

When an operator carries out the arrangement work in such a manner that the operator mounts the punches P and the die D according to shape and length of the workpiece W, for example, a plurality of angle sensor units 239 shown in FIG. 15 as a plurality of bending angle detecting devices for detecting the bending angle of the workpiece W, i.e. the three angle sensor units 239 in this embodiment are arranged in suitable positions in the longitudinal direction of the network die holder 227 and are mounted to gaps between the adjacent divided dies Ds.

At this time, the angle sensor units 239 are mounted, as shown in FIG. 12, so as to come in contact with the resistance rail electrodes 229 and the copper rail electrodes 231.

With reference to FIGS. 15 and 16, the angle sensor units 239 are composed of a unit base 241 which can be inserted and detached into/from the gap between the adjacent divided dies Ds, a contact supporting plate 245 having a V shape which is normally biased upward at the upper portion of the unit base 241 via two compressing springs 243, and semi-circular rotational contacts 247 which are borne to both sides of the V-shaped upper portion of the contact supporting plate 245. The two compressing springs 243, the contact supporting plate 245 and the two rotational contacts 247 as well as the unit base 241 can be inserted into and detached from the gap between the adjacent divided dies Ds as shown in FIG. 16.

Further, an auxiliary base 249 is installed to the unit base 241 so as to positioned on the outside of the divide dies Ds in this embodiment. A linear scale 253 is fixed to the other end of a tension spring 251 whose one end is mounted to the lower portion of the auxiliary base 249, and, in a state that, for example, a wire 255 as a linear element is wound by ¼ and half windings around outer peripheral surface of the rotational contact 247 via a plurality of wheels 257 from the upper end of the linear scale 253, one end of the wire 255 is fixed to the outer peripheral surface of the rotational contact 247. The other rotational contact 247 has the same structure, and in FIG. 15 the wire 255 and the plural wheels 257 are shown by dotted lines.

Therefore, since the two rotational contacts 247 are normally drawn downward by the tension spring 251, in the normal state, they are stopped by a stopper, not shown, so that the arc portions of the rotational contacts 247 are positioned in the horizontal state. The arc portions of the rotational contacts 247 are in a position which is approximately same as or slightly higher than the upper surface of the die D in the normal state.

In addition, for example, a reading head 259 as a scale moving amount detecting device for detecting a moving amount of the linear scale 253 is mounted to the vicinity of each linear scale 253 in the auxiliary base 249, and the reading heads 259 are connected with the control device 237.

According to the above structure, as the workpiece W is being bent by the cooperation of the punches P and the die D, the two rotational contacts 247 pivot according to the bending state of the workpiece W, and accordingly the wires 255 are drawn against the biasing forces of the tension springs 251, so that the linear scales 253 lift. Moving amounts of the linear scales 253 are read by the reading heads 259, so that the rotating amounts of the rotational contacts 247 are detected, and the bending angle of the workpiece W is calculated by the control device 237 so as to be detected.

On the bottom portion of the network die holder 227, as shown in FIG. 16, a detecting line 261, which is electrically connected with the control device 237, as well as the above-mentioned resistance rail electrode 229 and the copper rail electrode 231 is wired. Moreover, since a signal line terminal 263 which is connected with the reading head 259 is provided to the lower portion of the unit base 241 of the angle sensor unit 239 so as to be capable of contacting with the detecting line 261, the angle sensor units 239 can be inserted and easily mounted into the gaps between the adjacent divided dies Ds with suitable intervals so as to be capable of measuring angles of plural places of the workpiece W in its longitudinal direction. Here, a connecting terminal 265 which can come in contact with the resistance rail electrode 229 and the copper rail electrode 231 is also provided to the lower portion of the unit base 241.

Figure 17:
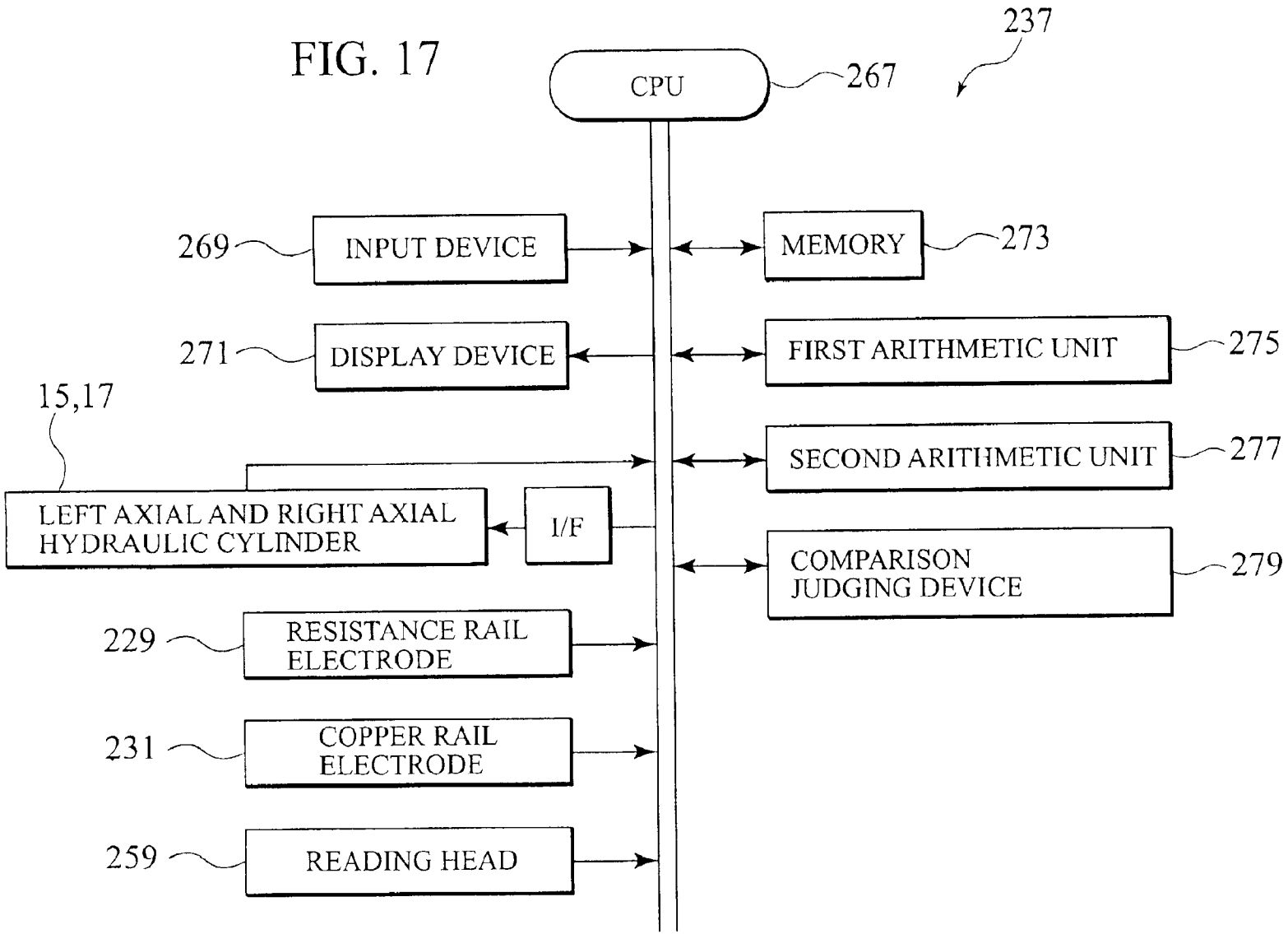
FIG. 17 is a structural block diagram of the control device.

With reference to FIG. 17, in the control unit 237, a CPU 267 as a central processing unit is electrically connected with, for example, an input device 269 as bending condition input means for inputting data such as a material, a thickness, a working shape, a mold condition, a target bending angle and a working program of the workpiece W, and a display device 271 such as a CRT display and a memory 273 for storing the input data.

In addition, the CPU 267 is connected with, for example, a first arithmetic unit 275 as a position calculating unit which are brought into conductive with the resistance rail electrode 229 and the copper rail electrode (ground-use rail electrode) 231 during the bending so as to calculate distances from reference position of the network die holder 227 to the angle sensor units 239, and with a second arithmetic unit 277 for calculating the bending angle based on signals from the reading heads 259 which read the moving amounts of the linear scales 253 of the angle sensor units 239.

In addition, the CPU 267 is connected with a comparison judging device 279 for detecting the bending state of the workpiece W from the positions of the angle sensor units 239 obtained by the first arithmetic unit 275 and the bending angles of the workpiece W detected by the angle sensor units 239 at real time and comparing and judging the detected bending state of the workpiece Wand a target angle so as to giving an instruction for adjusting the gaps between the punches P and the die D in order to carrying out suitable bending.

Next, there will be explained below the position detecting principle in which the positions of the angle sensor units 239 are calculated by the first arithmetic unit 275.

Figure 14:
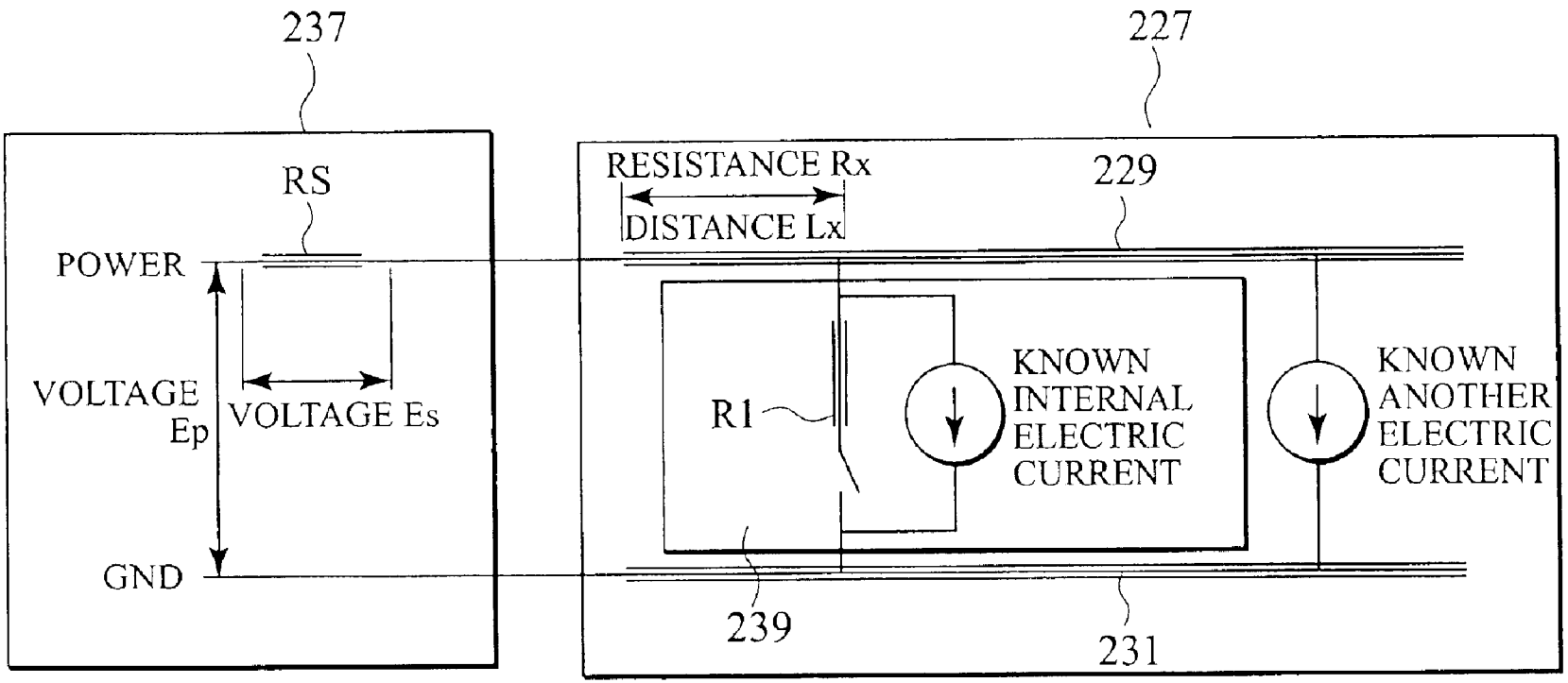
FIG. 14 is a schematic diagram explaining a principle of position detection of an angle sensor unit according to the embodiment of the present invention.

With reference to FIG. 14, when the angle sensor unit 239 comes in contact with the resistance rail electrode 229 and the copper rail electrode 231 and receives a power source, the communication with the control device 237 is carried out.

A voltage Ep is applied to the resistance rail electrode 229 and the copper rail electrode 231. A shunt resistance Rs is provided to the resistance rail electrode 229 of the control device 237, and a voltage Es is applied to the shunt resistance Rs. The inside of the angle sensor unit 239 is connected with a resistance R1.

Since resistance of the resistance rail electrode 229 is low, namely, about 1 Ω/m, a distance Lx from the reference position of the network die holder 227 to the angle sensor unit 239 is calculated from the resistance Rx of the resistance rail electrode 229.

In the control device 237, a packet for requesting ON of the resistance R1 is transmitted to the angle sensor unit 239 whose position is desired to be detected. When the angle sensor unit 239 receives the packet, the resistance R1 is ON only for a certain time. In the control device 237, the voltage Es and the voltage Ep are measured within the time for which the resistance R1 is ON.

Thereafter, in the control device 237, a packet for requesting OFF of the resistance R1 is transmitted. In such a manner, the packets for ON and OFF are transmitted to the desired angle sensor unit 239 so that the shaft resistance Rs and the resistance R1 are measured.

The resistance Rx is calculated based on the following equation (1) by using the voltage Es, the voltage Ep, and the measured results of the shaft resistance Rs and resistance R1.

$$Rx=Rs(Ep/Es-1)-R1 \quad (1)$$

When the resistance of the resistance rail electrode 229 is supposed to be 1 Ω/m, the distance Lx from the reference position of the network die holder 227 to the angle sensor unit 239 becomes Rx/1 (unit: m) from Rx obtained in the above manner.

With the above structure, the operator combines the divided dies Ds and arranges the die D based on the bending information of the workpiece W at the time of the arrangement work, and in this embodiment, the three angle sensor units 239 are arranged in suitable positions of the network die holder 227 in its longitudinal direction. Lower connecting terminals 265 of the unit bases 241 of the three angle sensor units 239 come in contact with the resistance rail electrode 229 and the coper rail electrode 231 on the bottom portion of the network die holder 227, and signal line terminals 263 of the lower portions of the unit bases 241 also come in contact with the detecting line 261 on the bottom portion of the network die holder 227.

According to the above-mentioned procedure, in the control unit 237, the positions of the angle sensor units 239 are detected automatically.

In addition, the workpiece W is located and set on the die D, and the punches P lower so that the workpiece W is bent. The bending angles and the tilt of the workpiece W are measured at real time by the angle sensor units 239 so as to be transmitted to the control device 237 during the bending.

In the control device 237, the bending angles received by the angle sensor units 239 are judged by the comparison judging device 279 as to whether or not the bending angles reach the target angle.

In the case where the bending angles of the plural angle sensor units 239 scatter, the pressurizing forces of the pistons of the crowning cylinders 23 and 25 as the crowning devices are controlled and the deflection amount of the lower table 7 is adjusted so that the gaps between the punches P and the die D are finely adjusted.

Further, when the bending angles of the workpiece W do not reach the target angle, the left axial and right axial hydraulic cylinders 15 and 17 are controlled and a stroke of the upper table 5 is controlled so that the minimum unit of the gaps between the punches P and the die D is transmitted. When the bending angles reach the target angle, the bending is ended.

Accordingly, the positions of the angle sensor units 239 arranged by the arrangement work are automatically detected and the bending angles of the workpiece W are detected by the angle sensor units 239 at real time, the bending state of the workpiece W is detected at real time. For this season, a ram driving amount (compensation amount) and a crowning amount are calculated easily in order to obtain accuracy of go-angle. Therefore, since the gaps between the punches P and the die D can be finely adjusted accurately based on the calculated ran driving amount (compensation amount) and crowning amount, a product with highly accurate bending angle can be worked.

Here, since the position of the lower table 7 to which the angle sensor units 239 are mounted is automatically detected, the time which is conventionally required for reading and manually inputting the positions of the angle sensor units 39 through the operator is omitted, and human error can be avoided.

Next, there will be explained below the bending method and the apparatus thereof according to another embodiment of the present invention. Members in this embodiment similar to those in the above-mentioned embodiments are designated by like reference numerals.

Even if the positions of the angle sensor units 239 in this embodiment are not automatically detected unlike the case of the aforementioned embodiments, they can be detected by simple manual input through the operator.

Figure 18:
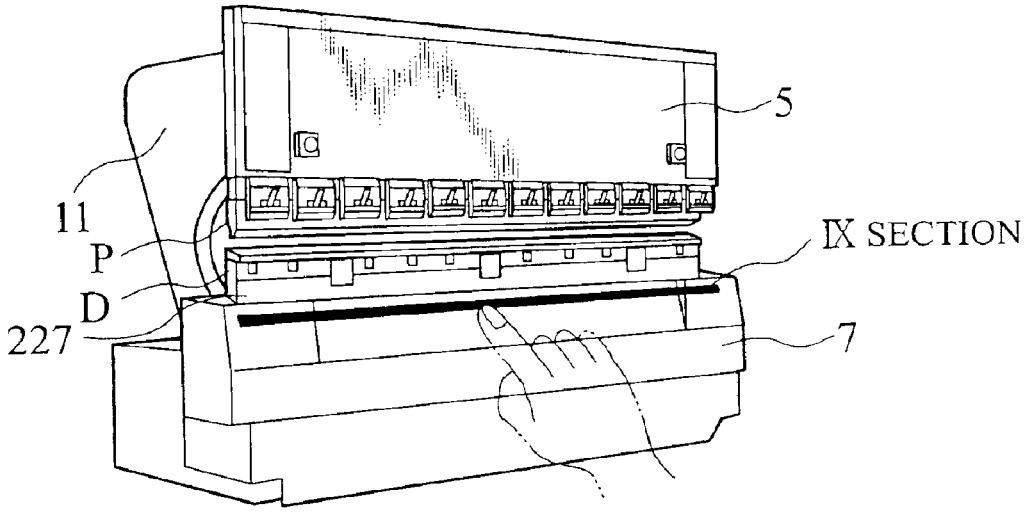
FIG. 18 is a general perspective view of the press brake according to still another embodiment of the present invention.
Figure 19:
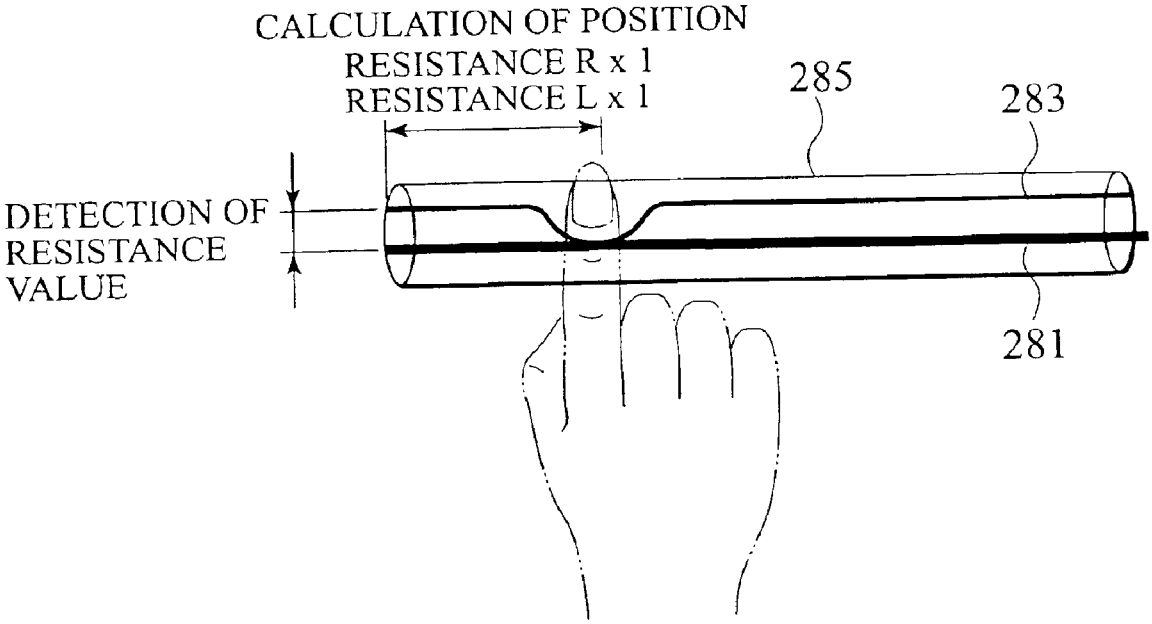
FIG. 19 is a mimetic diagram showing a detail of the IX portion of FIG. 18.

With reference to FIGS. 18 and 19, a copper line 281 (corresponding to the copper rail electrode 231) and a resistance line 283 (corresponding to the resistance rail electrode 229) are wired parallel in a vicinity position of the die D of the lower table 7 so as to face the longitudinal direction of the lower table 7 and not to come in contact with each other in a coating body 285.

One end sides of the copper line 281 and the resistance line 283 are electrically connected with the control device 237 similarly to the copper rail electrode 231 and the resistance rail electrode 229 of the aforementioned embodiment.

Therefore, as shown in FIG. 19, the operator pressurizes a portion of the coating body 285 corresponding to one of the copper line 281 and the resistance line 283 to the other direction using fingers, so that the copper line 281 and the resistance line 283 are short-circuited. At this time, an electric current according to the short-circuited position flows in the copper line 281 and the resistance line 283. Since this electric current is detected by the control device 237 and a resistance value Rx1 of the distance from the reference position of the one end sides of the copper line 281 and the resistance line 283 to the short-circuited position is calculated, when the resistance of the resistance line 283 is supposed to be 1 Ω/m, similarly to the aforementioned embodiment, a distance Lx1 from the reference position to the short-circuited position becomes Rx1/1 (unit: m) according to Rx1 obtained in the above manner.

Therefore, as shown in FIGS. 18 and 19, the operator pushes the coating body 285 in the position of the angle sensor unit 239 whose position is desired to be detected through the fingers so that the copper line 281 and the resistance line 283 are short-circuited, thereby easily obtaining the distance from the reference position to the position the angle sensor unit 239 and easily inputting the position of the angle sensor unit 239. The other members of this embodiment are similar to those in the aforementioned embodiments, and although the positions of the angle sensor units 239 are detected automatically in the former embodiments and the positions are detected by easy manual input in the latter embodiment, their functions and effects are approximately similar.

Here, the present invention is not limited to the aforementioned plural embodiments, suitable modification and alternation can be carried out so that the invention can be carried out in another embodiments. For example, the upper table moves up and down in the aforementioned embodiments, but the lower table may be moved up and down so that the bending is carried out.

What is claimed is:

1. A bending apparatus that reciprocates at least one of an upper table to which a punch is mounted and a lower table to which a corresponding plurality of adjacent divided dies are mounted, the bending apparatus comprising:

at least one bending angle detector, provided between the dies, that detects a bending angle of the workpiece;

a main body that inserts the bending angle detector into a gap between the dies and that withdraws the bending angle detector from the gap between the dies;

a lift that is biased upward by a first elastic body and that is configured to be pressed downward by the workpiece at approximately a center of a groove portion of the dies, the lift including a first engagement member;

a rotor support that is biased upward by two second elastic bodies having smaller biasing forces than the first elastic body, the rotor support including second engagement members;

two rotors on opposite sides of the groove portion at an upper portion of the rotor support, the two rotors including workpiece contacts that contact the workpiece;

links that rotatably engage the first engagement member to stop an upper end of the lift in a position lower than an upper surface of the dies, and that rotatably engage the second engagement members to position the workpiece contacts below the upper surface of the dies; and a bending angle calculator that converts rotating amounts of the two rotors into bending angles of the workpiece.

2. The bending apparatus according to claim 1, wherein a gap between pivots of the two rotors is wider than a width of the groove portion of the dies.

3. The bending apparatus according to claim 2, wherein the rotors have a semicircular shape and linear workpiece contacts.

4. A bending apparatus that reciprocates at least one of an upper table to which a punch is mounted and a lower table to which a corresponding plurality of adjacent divided dies are mounted, the bending apparatus comprising:

at least one bending angle detector, provided between the dies, that detects a bending angle of the workpiece;

a main body that inserts the bending angle detector into a gap between the dies and that withdraws the bending angle detector from the gap between the dies;

a lift that is biased upward by a first elastic body and that is configured to be pressed downward by the workpiece at approximately a center of a groove portion of the dies, the lift including a link engagement member;

a damper buffer provided on an outer periphery of the lift to be vertically movable;

guides that are biased upward by two damper elastic bodies at opposing sides of the damper buffer;

at least one link having a first end rotatably engaged with the link engagement member and a second end rotatably engaged with a lower surface of the damper buffer so as to lift the damper buffer;

a rotor support provided integrally with the guides;

two rotors on opposite sides of the groove portion at an upper portion of the rotor support, the two rotors including workpiece contacts that contact the workpiece; and a bending angle calculator that converts rotating amounts of the two rotors into bending angles of the workpiece.

5. The bending apparatus according to claim 4, wherein a gap between pivots of the two rotors is wider than a width of the groove portion of the dies.

6. The bending apparatus according to claim 4, further comprising:

stopper sections, provided to the guides, that restrain a gap in a direction where the guides and the damper buffer repel each other due to the biasing forces of the two damper elastic bodies.

7. A bending method in which at least one of an upper table, to which a punch is mounted, and a lower table, to which adjacent divided dies are mounted via a die holder, is reciprocated, the method comprising:

wiring two rail electrodes, comprising a resistance rail electrode and a ground-use rail electrode, to the die holder in a longitudinal direction of the die holder;

arranging a plurality of bending angle detectors, that detect a bending angle of the workpiece, in the longitudinal direction of the die holder;

bringing the bending angle detectors into contact with the two rail electrodes;

making the two rail electrodes conductive during bending so as to measure resistance values of the resistance rail electrode from a reference position of the die holder to the bending angle detectors;

calculating positions of the bending angle detectors based on the resistance values;

detecting bending angles of the workpiece using the bending angle detectors; and bending the workpiece so that the bending angles of the workpiece detected by the bending angle detectors reach a target angle.

8. The bending method according to claim 7, wherein a crowning amount is adjusted so that the bending angles of the workpiece in the bending angle detectors become uniform.

9. A bending method in which at least one of an upper table to which a punch is mounted, and a lower table, to which a corresponding plurality of adjacent divided dies are mounted via a die holder, is reciprocated, the method comprising:

wiring a resistance line and an electric wire approximately parallel in a coating body of the lower table so as to remain spaced from each other;

arranging a plurality of bending angle detectors, that detect a bending angle of the workpiece, in a longitudinal direction of the die holder;

making the resistance line and the electric wire conductive during bending;

externally pushing the bending angle detectors so as to bring the resistance line and the electric wire into contact with each other;

converting resistance values from a reference position of the lower table to the bending angle detectors into distances using an electric current flowing when externally pushing the plural bending angle detectors;

detecting bending angles of the workpiece using the bending angle detectors; and bending the workpiece so that the bending angles of the workpiece detected by the bending angle detectors reach a target angle.

10. The bending method according to claim 9, wherein a crowning amount is adjusted so that the bending angles of the workpiece in the bending angle detectors are made uniform.

11. A bending apparatus that reciprocates at least one of an upper table to which a punch is mounted and a lower table to which a plurality of adjacent divided dies are mounted via a die holder, the bending apparatus comprising:

a resistance rail electrode wired to the die holder in a longitudinal direction of the die holder;

a ground-use rail electrode;

a plurality of bending angle detectors that detect bending angles of the workpiece, the bending angle detectors being arranged at positions spaced along the longitudinal direction of the die holder so as to come in contact with the two rail electrodes;

a position calculator that makes the two rail electrodes conductive during bending so as to measure resistance values of the resistance rail electrode and calculate distances of a reference position of the die holder to the bending angle detectors based on the measured resistance values; and a comparison judging device that detects a bending state of the workpiece from positions of the bending angle detectors obtained by the position calculator and the bending angles of the workpiece detected by the bending angle detectors, wherein the comparison judging device compares an angle associated with the detected bending state of the workpiece with a target angle and adjusts the gaps between the punch and the dies based upon the comparison.

12. The bending apparatus according to claim 11, each of the bending angle detectors comprising:

a unit base configured to be inserted into and withdrawn from the gap between the dies;

a contact supporting plate that is biased upward at an upper portion of the unit base;

two semicircular rotational contacts on opposing sides of a groove portion at an upper portion of the contact supporting plate;

linear scales which are biased to be freely movable via linear elements which are wound around outer peripheral surfaces of two semicircular rotational contacts, so that arc portions of the two semicircular rotational contacts are approximately flush with an upper surface of the dies; and scale moving amount detectors that detect moving amounts of the linear scales.

13. A bending apparatus that reciprocates at least one of an upper table to which a punch is mounted and a lower table to which a plurality of adjacent divided dies are mounted via a die holder, the bending apparatus comprising:

a position detector configured so that a resistance line and an electric wire are spaced from each other and extend approximately parallel in a coating body of the lower table;

a plurality of bending angle detectors, arranged in a longitudinal direction of the die holder, that detect a bending angle of the workpiece;

a position calculator that calculates a distance from a reference position of the lower table to a contact position between the resistance line and the electric wire based on an electric current which flows when the resistance line and electric wire are made conductive during bending and the plural bending angle detectors are externally pushed so that the resistance line and electric wire are brought into contact with each other; and a comparison judging device that detects a bending state of the workpiece from the positions of the bending angle detectors obtained by the position calculator and the bending angles detected by the bending angle detectors, wherein the comparison judging device compares an angle associated with the detected bending state of the workpiece with a target angle and adjusts gaps between the punch and die.

14. The bending apparatus according to claim 13, each of the bending angle detectors comprising:

a unit base configured to be inserted into and withdrawn from the gap between the dies;

a contact supporting plate that is biased upward to the upper portion of the unit base;

two semicircular rotational contacts on opposing ends of the dies at a center of a groove portion of the dies at the upper portion of the contact supporting plate;

linear scales which are biased to be drawn movably via linear elements which are wound around outer peripheral surfaces of the two semicircular rotational contacts, so that arc portions of the two semicircular rotational contacts are approximately flush with an upper surface of the dies; and scale moving amount detectors that detect moving amounts of the linear scales.

* * * * *

UNITED STATES PATENT AND TRADEMARK OFFICE

CERTIFICATE OF CORRECTION

PATENT NO. : 6,959,573 B2
APPLICATION NO. : 10/343836
DATED : November 1, 2005
INVENTOR(S) : M. Matsumoto et al.

It is certified that error appears in the above-identified patent and that said Letters Patent is hereby corrected as shown below:

On the cover of the printed, at Item (54), Title, "Bending Method and Device Therefore" should be ---Bending Method and Apparatus Thereof---.

Signed and Sealed this

Twenty-second Day of August, 2006

JON W. DUDAS
*Director of the United States Patent and Trademark Office*